US008587454B1

(12) United States Patent
Dearworth

(10) Patent No.: US 8,587,454 B1
(45) Date of Patent: Nov. 19, 2013

(54) SYSTEM AND METHOD FOR PROVIDING ELECTRONIC TOLL COLLECTION TO USERS OF WIRELESS MOBILE DEVICES

(76) Inventor: Rich Dearworth, Cincinnati, OH (US)

( * ) Notice: Subject to any disclaimer, the term of this patent is extended or adjusted under 35 U.S.C. 154(b) by 1036 days.

(21) Appl. No.: 12/621,178

(22) Filed: Nov. 18, 2009

Related U.S. Application Data

(60) Provisional application No. 61/115,805, filed on Nov. 18, 2008.

(51) Int. Cl.
*G08G 1/00* (2006.01)

(52) U.S. Cl.
USPC ..... 340/928; 340/905; 340/933; 340/988; 340/539.1; 340/5.1; 455/456.1; 701/117; 701/467; 701/517

(58) Field of Classification Search
USPC ..... 340/928, 905, 933, 935, 988, 991, 993, 340/539.1, 539.11, 539.23, 5.1, 5.2, 995.2, 340/995.22; 455/456.1; 701/117, 467, 517
See application file for complete search history.

(56) References Cited

U.S. PATENT DOCUMENTS

| | | | | |
|---|---|---|---|---|
| 5,991,749 | A | 11/1999 | Morrill, Jr. | |
| RE39,736 | E | 7/2007 | Morrill, Jr. | |
| 7,630,918 | B2 * | 12/2009 | Gila et al. | 705/13 |
| 2006/0258367 | A1 | 11/2006 | Chiang | |
| 2007/0285280 | A1 | 12/2007 | Robinson et al. | |

FOREIGN PATENT DOCUMENTS

| | | | |
|---|---|---|---|
| JP | 08297700 | A | 11/1996 |
| JP | 11110593 | A | 4/1999 |
| JP | 2000175800 | A | 6/2000 |
| JP | 2002042192 | A | 2/2002 |
| JP | 2002074432 | A | 3/2002 |
| JP | 2002083331 | A | 3/2002 |
| JP | 2002083334 | A | 3/2002 |
| JP | 2002269604 | A | 9/2002 |
| JP | 2002269610 | A | 9/2002 |
| JP | 2003208645 | A | 7/2003 |
| JP | 2003216993 | A | 7/2003 |
| JP | 2003217078 | A | 7/2003 |
| JP | 2003271836 | A | 9/2003 |
| JP | 2004040167 | A | 2/2004 |
| JP | 2004213569 | A | 7/2004 |
| JP | 2004219093 | A | 8/2004 |
| JP | 2004288099 | A | 10/2004 |
| JP | 2005056094 | A | 3/2005 |
| JP | 2005084995 | A | 3/2005 |
| JP | 2005316737 | A | 11/2005 |
| JP | 2006163457 | A | 6/2006 |

(Continued)

*Primary Examiner* — Daryl Pope

(74) *Attorney, Agent, or Firm* — Wood, Herron & Evans, LLP

(57) ABSTRACT

Electronic toll collection for a motorist and/or subscriber having a wireless mobile device that links the device to (a) specific vehicle(s) and billing account(s) with a service provider(s), third party(s) and or toll authority(s). When a motorist having the mobile device in the vehicle approaches and passes a "virtual" toll location(s) and/or "virtual" toll barriers(s) and/or "virtual" toll boundary(s) having a given toll a central server determines whether the motorist and/or subscriber has activated an electronic ETC service associated with the mobile device, and sends a charge transaction from the central server to a service provider(s), third party(s) and/or directly to the toll authority(s) system. After every transaction, a confirmation (which may be SMS or text, vibration, voice, audible alert, email, etc.) is sent to the mobile device and/or subscriber indicating the amount paid and the status of the account.

43 Claims, 17 Drawing Sheets

(56) References Cited

FOREIGN PATENT DOCUMENTS

| | | | |
|---|---|---|---|
| JP | 2007058300 | A | 3/2007 |
| JP | 2007316886 | A | 12/2007 |
| JP | 2008021327 | A | 1/2008 |
| WO | WO-2007081833 | A2 | 7/2007 |
| WO | WO-2009042025 | A1 | 4/2009 |

* cited by examiner

100

300

400

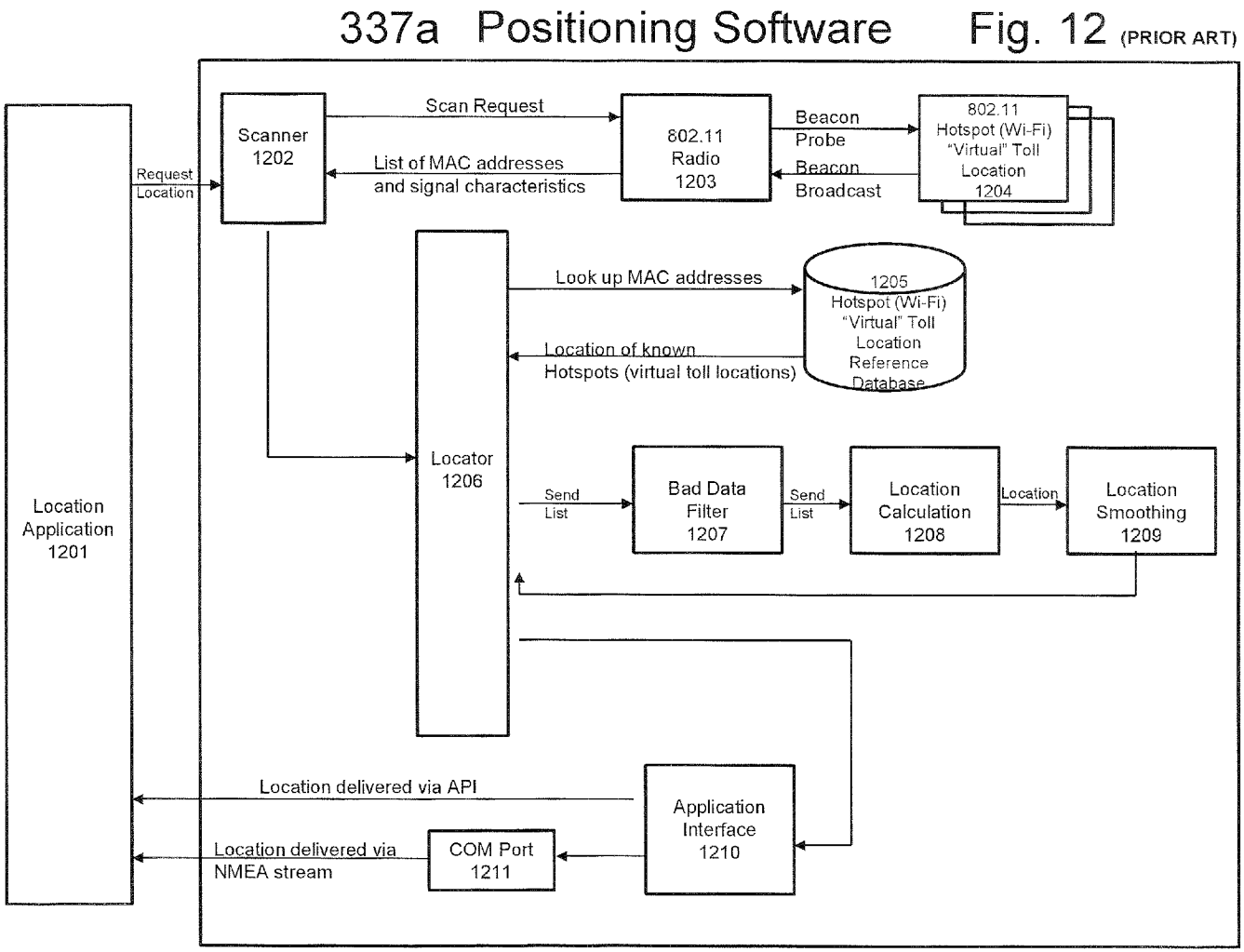
337a Positioning Software
Fig. 12 (PRIOR ART)
Scanner 1202
Scan Request
List of MAC addresses and signal characteristics
802.11 Radio 1203
Beacon Probe
Beacon Broadcast
802.11 Hotspot (Wi-Fi) "Virtual" Toll Location 1204
Request Location
Location Application 1201
Look up MAC addresses
Location of known Hotspots (virtual toll locations)
1205 Hotspot (Wi-Fi) "Virtual" Toll Location Reference Database
Locator 1206
Send List
Bad Data Filter 1207
Send List
Location Calculation 1208
Location
Location Smoothing 1209
Application Interface 1210
COM Port 1211
Location delivered via API
Location delivered via NMEA stream

Fig. 17

1700

HeaderField 1702

1703

-header:Font : Font
-title : String
-showSignal : boolean
-showBattery : boolean
-showTitle : boolean
-fieldHeight : int
-fontColor : int
-backgroundColor :int
-batteryBackground : int
-signalBarColor : int
-systemListener : SystemListener
-radioStatusListener : RadioStatusListener
-listenersActive : boolean
-signalLevel : int
-batteryLevel : int

1705

<<constructor>>+HeaderField( title : String )
#onBatteryStatusChanged() : void
#onRadioStatusChanged() : void
#onDisplay() : void
#onExposed() : void
#onObscured() : void
#onUndisplay() : void
-checkAddListeners() : void
-checkRemoveListeners() : void
+removeListeners() : void
<<setter>>+setTtile( title : String ) : void
<<setter>>+setFontColor( fontColor : int) : void
<<setter>>+setBatteryBackground( batteryBackground :int)
<<setter>>+setBackgroungColor( backgroundColor : int)
+showSignal( bool : boolean ) : void
+showBattery( bool : boolean ) : void
#layout(width : int, height : int ) : void
<<getter>>+getPreferredWidth() : int
<<getter>>+getPreferredHeight() : int
#paint( graphics : Graphics ) : void
-drawSignalIndicator( graphics : Graphics ) : void
-drawBatteryIndicator( graphics : Graphics ) : void

GPSLocation Provider 1704

1707

- Instance : GPSLocationProvider
-MAX_INVALID_TIME : int = 3*60*1000{read only}
-isMultipleFixes : boolean = true
-- FALL_BACK_COUNTER_THRESHOLD : int = 2{readOnly}
-_fallBackCounter : int = FALL_BACK_COUNTER_THRESHOLD
-_isSmartMode : boolean = false
-_inCoverage : boolean = (RadioInfo.getState()==RadioInfo.STATE_ON)?true:false
-_sendNotification : boolean = false
-_provider : LocationProvider
-_criteria : Criteria
-_frequency : int
-_timeout : int
-_maxage : int
-_currentCoordinates : Coordinates
-_previousCoordinates : Coordinates
-totalUpdates : int
-validUpdates : int
-invalidUpdates : int
-assistedUpdates : int
-unassistedUpdates : int
-lastValid : long = System.currentTimeMillis()
-lastReset : long = -1
-isVerizonNetwork : boolean = false

1709

<<constructor>>-GPSLocationProvider()
<<getter>>+getInstance() : GPSLocationProvider(guarded)
<<setter>>-setupPDE() : void
<<getter>>-getGPSMode() : byte
<<getter>>-getCostAllowed() : boolean
<<setter>>-setupCriteria() : void
-shutdownProvider() : void
<<setter>>-setupProvider() : void
-singleFixLocationUpdate() : void
<<getter>>-getLocMethodString( method : int ) : String
+stop() : void
+start() : void

Fig. 18

1800

SpacerField 1802

1803

-font : Font = Font.getDefault()
-fieldHeight : int
-backgroundColour : int = -1
-underlineColour : int = -1
-fontColour : int = 0x666666
-text : String = **

1805

<<constructor>>+SpacerField(_fieldHeight : int )
<<constructor>>+SpacerField(_fieldHeight : int ,_backgroundColour : int)
<<constructor>>+SpacerField(_fieldHeight : int ,_backgroundColour : int,_text : String )
<<constructor>>+SpacerField(_fieldHeight : int ,_backgroundColour : int,_text : String,_underlineColour : int )
<<constructor>>-GPSLocationProvider()
<<setter>>-setHeight(_fieldHeight : int ) : void
<<setter>>-setBackgroundColour(_backgroundColour : int ) : void
<<setter>>-setFontColour(_fontColour : int ) : void
<<setter>>-setText(_text : String ) : void
<<setter>>+setUnderline(_underlineColour : int ) : void
#layout( width : int, height : int ) : void
<<getter>>+getPreferredWidth() : int
<<getter>>+getPreferredHeight() : int
#paint( graphics : Graphics ) : void

Logger 1804

1807

-monitor : Object = new Object(){readOnly}
-levels : String"II"[0..*] = new String[]{**,*[fatal]*,*[error]*,*[wam]*,*[info]*,*[debug]}

1809

<<constructor>>-Logger()
-log( level : byte, message : String ) : void
+debugLog( message : String ) : void
+infoLog( message : String ) : void
+warnLog( message : String ) : void
+errorLog( message : String ) : void
+fatalLog( message : String ) : void
<<getter>>-getLoggingLevel() : byte
<<getter>>-isLoggingEnable() : boolean

*LinkField* 1806

<<constructor>>+LinkField( label : String )
<<constructor>>+LinkField( label : String, style : long )
#paint ( graphics : Graphics ) : void
+navigationClick( status : int, time : int ) : boolean
#keyChar( character : char, status : int, time : int ) : boolean
*#Invoke() : void*

1811

Fig. 19

1900

CustomButtonField 1902

<<constructor>>+CustomButtonField( label : String, style : long )
<<constructor>>+CustomButtonField( label : String )
+navigationClick( status : int, time : int ) : boolean
#keyChar( character : char, status : int, time : int ) : boolean
*#Invoke() : void*

1903

CustomLabelField 1910

<<constructor>>+CustomLabelField( label : String, topBottomMargin :int )

1913

VirtualTollLocationsListener 1904

-dialog : Dialog = null
<<constructor>>+VirtualTollListener()
+monitoringStateChanged( isMonitoringActive : boolean ) : void
+proximityEvent( coordinates : Coordinates, location : Location ) : void

1905

1907

LocListener 1912

+locationUpdated( provider : LocationProvider, location : Location ) : void
+providerStateChanged( provider : LocationProvider, newState : int ) : void

1915

GlobalUtil 1906

<<getter>>+isPearl() : boolean
+notifyUser( message : String ) : void
+pushGlobalScreen( screen : Screen ) : void

1909

GlobalConfig 1914

+VirtualTollLocationsPersistenceStore : Hashable = new Hashable()
+ALTITUDE : float = ){readOnly}
+PROXIMITY_RADIUS : float = 500{readOnly}
-SMALL_FONT_SIZE : int = 9{readOnly}
-SMALL_FONT_SIZE_PEARL : int = 7{readOnly}
-LARGE_FONT SIZE : int = 9{readOnly}
-TESTING : boolean = false{readOnly}
-LAT ARRAY : double"[]" [0..*] = {39.22765, 39.224916}
-LON ARRAY : double "[]* [0..*] = {-84.3894,-84.380033}
-DESC ARRAY : String "[]* [0..*] = {"Driveway Bump", "East on SR126 Blue Ash Road Exit"}

+GetDeafultFontFamily() : FontFamily
+GetFont() : Font
+GetFont( fontSize : int ) : Font
+GetBoldFont() : Font
+GetBoldFont( fontSize : int ) : Font
+GetBoldUnderLinedFont() : Font
+GetFont( style : int, fontSize : int, units : int ) : Font
+GetHeaderFontFamily() : FontFamily

1917

1919

ApplicationLoader 1908

+main( args : String"[]" ) : void
<<constructor>>~ApplicationLoader()

1911

SYSTEM AND METHOD FOR PROVIDING ELECTRONIC TOLL COLLECTION TO USERS OF WIRELESS MOBILE DEVICES

RELATED APPLICATIONS

The present application claims priority to U.S. Ser. No. 61/115,805 filed Nov. 18, 2008, the disclosure of which is hereby incorporated herein by reference in its entirety.

FIELD OF THE INVENTION

The present invention is directed to systems and methods that use the real-time geographic location of a wireless mobile device in a vehicle relative to "virtual" toll locations and/or "virtual" toll barriers and/or "virtual" toll boundaries in lieu of using the locations of actual toll plazas, toll booths, toll stations, toll gates, toll bridges, toll tunnels, toll barriers, parking tolls and/or any locations and/or barriers designated for a toll etc. for paying tolls (Electronic Toll Collection).

BACKGROUND OF THE INVENTION

The background of the invention includes the following areas of technology:

A) Electronic Toll Collection (ETC)
B) Global Position Systems (GPS)
C) Waypoints and Wi-Fi hotspots
D) Geocoding
E) Navigational Systems
F) Communications Systems All of these areas contribute various perspectives that illustrate the advantages and benefits of the invention.

A) Electronic Toll Collection (ETC)

Over the last 25 years, the crowding of highways within metropolitan areas has resulted in the development of additional traffic arteries, including fee-bearing roads known as toll roads. Toll roads have become increasingly popular; however, they require the payment of a toll fee for use by vehicular occupants and/or subscribers. The collection of tolls by conventional means has had a negative effect upon highway throughput and safety. Congestion and long backups at toll plazas are becoming more common. Such conditions involve a significant economic cost, through lost time and reduced productivity. The number of idling vehicles at a toll booth has a negative environmental impact. Moreover, serious accidents at toll plazas, caused by operators or mechanical failures, have also increased in frequency.

Toll authorities have attempted to respond to these problems by providing coin-operated toll collection devices, or by instituting a toll-plate system in which toll-takers visually inspect each incoming vehicle for an appropriate toll plate or sticker. Coin operated toll collection systems do little to increase throughput, and are susceptible to fraud through the use of counterfeit coins. Toll-plate systems suffer the same deficiencies, requiring each vehicle to slow sharply while entering the visual inspection area.

Around 1990, a development ensued that helped to revolutionize toll road travel. This was the development of the electronic toll collection device.

One example of an electronic toll collection device is set forth and shown in U.S. Pat. No. 4,546,241 issued Oct. 8, 1985. This patent relates to an electronic identification and recognition system that includes a portable card having a circuit therein for generating and transmitting an identifying signal. The identifying signal includes predetermined frequency pulses. The card functions in cooperation with a reader, which radiates a radio frequency carrier signal received by an antenna in the card. This signal is used both to power the circuit of the card and to provide the basic frequency signal, which is modified to generate secondary frequency signals, which are transmitted back to the reader in a predetermined sequence identifying the card.

Today, those individuals who frequently use toll roads often purchase an electronic toll collection device or tag. The electronic toll collection device or tag allows the vehicular occupant to bypass the cash only toll plaza and, in many instances, the vehicle can maintain its normal speed as it traverses the toll plaza wherein the passage of the electronic toll collection device is recorded. The popularity of the electronic toll collection device has expanded to the point that the normal user of the electronic toll collection device now finds the common lines at toll plazas frustrating, in those instances where they cannot be avoided because the electronic toll collection device is not available.

Tolls on turnpikes, bridges, and other toll facilities are increasingly collected through the use of electronic toll collection devices. The use of such devices to pay tolls is both faster and more convenient than paying in cash or tokens. Electronic toll collections devices allow the toll facility operator to improve customer service and satisfaction by speeding passage through the toll plaza, removing the need for the customer to stop, fumble for change, or roll down a window.

The electronic toll collection device today typically takes the form of a transponder and/or tag that is attached to the inside of the windshield of a vehicle. The toll collection device stores a number identifying a user's account. At a suitably equipped tollbooth or toll plaza, the toll collection device is read to determine the account number, and a user's account is debited by the amount due for the toll. A user's account can be an individual and/or a business entity that represents many individuals. The user must from time to time add money to the account.

Toll authorities offer discounts for the use of electronic toll collection devices to those travelers that use them. Toll charges for a driver using a transponder or tag are often less than that of drivers without a transponder or tag.

In the state of the art, large customer-service centers are staffed to open and maintain accounts, manage toll collection device inventories and distribution, and provide responses to customer questions, complaints and other needs. To obtain a toll collection device, a potential user must visit one of a limited number of such customer-service centers, which may be in an inconvenient or even unsafe location and may have limited hours of operation, or they must order a toll collection device through the mail or over the Internet and then wait for it to arrive. Even users who already have toll collection devices often have to visit customer-service centers to replenish or otherwise manage their accounts. In addition to the inconvenience to the user, such an arrangement imposes a cost on the toll authority, which must hire enough staff to serve all potential customers.

Factors hindering full-speed electronic toll collection include (a.) significant non-participation, leading to lines in manual lanes and disorderly traffic patterns as the electronic- and manual-collection cars "sort themselves out" into their respective lanes; (b.) problems with pursuing toll evaders; (c.) the need, in at least some current (barrier) systems, to confine vehicles in lanes, while interacting with the collection devices, and the dangers of high-speed collisions with the confinement structures; (d.) vehicle hazards to toll employees present in some electronic-collection areas; (e.) the fact that in some areas at some times, long lines form even to pass through the electronic-collection lanes; and (f.) costs and other issues raised when retrofitting existing toll collection facilities. Union work rules of toll collectors can also be problematic.

Even if line lengths are the same in electronic lanes as in manual ones, electronic tolls save registered cars time: eliminating the stop at a window or toll machine, between successive cars passing the collection machine, means a fixed-length stretch of a journey through a toll plaza is traveled at a higher average speed, and in a lower time. This is at least a psychological improvement, even if the length of the lines in automated lanes is sufficient to make the no-stop-to-pay savings insignificant compared to the time spent waiting in line to pass the toll gate.

Despite these limitations, however, it is important to recognize that throughput increases if delay at the toll gate is reduced (i.e., if the tollbooth can serve more vehicles per hour). The greater the throughput of any toll lane, the fewer lanes required, so expensive construction can be deferred. Specifically, the toll-collecting authorities have incentives to resist pressure to limit the fraction of electronic lanes in order to limit the length of manual-lane lines. In the short term, the greater the fraction of automated lanes, the lower the cost of operation (once the capital costs of automating are amortized). In the long term, the greater the relative advantage of registering one's vehicle for electronic tolling, the faster cars will be converted from manual-toll use to electronic-toll use, and therefore the fewer manual-toll cars will drag down average speed and thus capacity.

Today, rental car agencies offer toll collection devices on a rental basis. A customer can choose to rent a transponder along with the rental of a car. Typically the fee for such a transponder rental is around $1.50 to $2.50 per day, in addition to the amount of tolls used. This method offers convenience to people that rent cars from rental car agencies that offer this service, but still leaves a need for travelers using their own cars and travelers that do not want to rent transponders or don't want to rent cars from the rental car agencies that offer them. Thus, a need exists for more cost effective systems and methods.

Current toll collection operations insist that customers purchase a transponder and/or tag up front, in order for them to take advantage of the benefits that electronic toll collection provides. This upfront cost may discourage some from purchasing a transponder and it therefore may be a barrier that reduces the number of potential electronic toll collection users.

Another issue is the desire to implement "open road tolling systems," which are systems that collect tolls only automatically, without manual intervention. Toll agencies need to collect tolls from frequent users, but also desire to provide access to occasional and transitional users such as tourists, business travelers and/or seasonal residents. The cost, time and inconvenience associated with traditional toll collection device distribution, and the inconvenience of account set up, typically mean that agencies need to maintain a fair number of lanes for cash collection tolls.

Some toll roads in recent years (for example, Highway 407 in Toronto) have moved to all-electronic collection that uses a combination of RFID tags and "pay by plate." In "pay by plate" the agency deploys a system to capture the license plate image in lieu of the toll collection device. It then accesses the Department of Motor Vehicles (DMV) database to obtain the vehicle owner's information and bills the vehicle owner for the transaction. This typically requires special legislation and expensive camera equipment and is therefore an expensive process to administer that drives up the cost of toll collection.

In the state of the art, Radio Frequency Identification Device (RFID) is being used for Electronic Vehicle Identification (EVI) for various purposes including toll collection. EVI specifically involves the use of RFID technology to electronically identify vehicles and validate the identity, status and authenticity of vehicle data. EVI enables government agencies to automatically detect and screen motor vehicles for compliance with government regulations. EVI also enables automated enforcement actions and violation processing as well as automated security monitoring and enforcement. In the future it is believed that an increasing number of governmental agencies will wish to implement EVI, which will accelerate the need to include electronic identification in vehicles. A need exist for systems and methods that can be linked together electronically and reduce the cost of implementing EVI.

In the state of the art a "flat tag" type of transponder is in use for toll collection. The flat tag is a decal sticker or thin card based transponder. Examples include the FasTrak tag used by the Transportation Core Agencies (TCA) in Orange County, Calif., and the eGo Plus Sticker Tag offered by TC IP, Ltd. d/b/a TransCore, for use with TransCore branded or other ANSI INCITS 256-2001 and ISO 10374 compliant tag readers. This type of transponder eliminates the drawbacks associated with the larger box type transponder. Another added benefit of the flat tag is a lower consumer price point. Flat tags are much less expensive to manufacture and can even be disposable. These tags should help toll authorities increase the number of electronic toll users, which is their stated mission. Using mobile devices in place of either transponders and/or tags would help toll authorities increase the number of electronic toll users and further reduce toll administration expense.

There are pending patent applications and existing patents that suggest using toll "zones" and/or toll "areas" in conjunction with wireless mobile devices such as cell phones for paying tolls. One example of this is set forth and shown in Patent Application Publication Number US2007/0285280 A1 dated Dec. 13, 2007 submitted by Rent-A-Toll, Inc., Plano, Tex. and entitled: "Providing toll services using a cellular device". Using "virtual" toll locations in lieu of toll "zones" and/or toll "areas" could be more accurate, timelier and more consistent with existing systems and methods.

Toll road enforcement is accomplished by a combination of a camera which takes a picture of the car and a radio frequency keyed computer which searches for a driver's window/bumper mounted transponder to verify and collect payment. The system sends a notice and fine to cars that pass through without having an active account or paying a toll.

Non-toll roads are financed using other sources of revenue, most typically fuel tax or general tax funds. Tolls have been placed on roads at various times in history, often to generate funds for repayment of toll revenue bonds used to finance construction and/or maintenance operations. As the road infrastructure in the US and Europe continue to age, it may become necessary to transform numerous non-toll roads into toll roads. A need thus exists to minimize the cost of any such transformations.

And finally, ETC systems rely on four major components: automated vehicle identification, automated vehicle classification, transaction processing, and violation enforcement. The four components are somewhat independent, and, in fact, some toll agencies have contracted out functions separately. In some cases, this division of functions has resulted in difficulties. In one notable example, the New Jersey E-ZPass regional consortium's Violation Enforcement contractor did not have access to the Violation Processing contractor's database of customers. This, together with installation problems in the automated vehicle identification system, has led to many customers receiving erroneous violation notices, and a violation system whose net income, after expenses, was negative, as well as customer dissatisfaction. A need exist for additional systems and methods that can eliminate these problems and electronically link to all appropriate existing systems.

B) Global Position Systems (GPS)

One technology that is finding more applications is global positioning systems (GPS). Through this technology, a geographic location for a person, place or device may be determined within a small margin of error. These devices work by triangulating signals received from at least three satellites orbiting the earth, and then through performance of various calculations, a precise geographic position may be determined. The devices created to perform these calculations have been miniaturized to the point that the components may be incorporated into a chip set which easily fits within handheld mobile devices such as GPS navigation devices from vendors such as Garmin, Magellan, TomTom, Navigon etc. and/or wireless communication devices such as cell/mobile phone devices, PDAs etc.

GPS receivers are described in several publications and references, such as the U.S. Pat. No. 5,528,248, issued on Jun. 18, 1996, which is hereby incorporated by reference herein in its entirety. This patent discloses a personal Digital Location Assistant based on a GPS Smart Antenna and a computing device.

WAAS stands for Wide Area Augmentation System for the American continent and EGNOS (European Geostationary Navigation Overlay System) for the European continent. Basically, they are systems of satellites and ground stations that provide GPS signal corrections that yield better position accuracy. A WAAS-capable receiver can provide position accuracy of better than three meters (10 feet).

Distances measured from an antenna to four or more satellites enable the antenna position to be calculated with reference to the global ellipsoid WGS-84. Local northing, easting and elevation coordinates can then be determined by applying appropriate datum transformation and map projection. By using carrier phase differences in any one of several known techniques, the antenna location can be determined to accuracy on the order of +/−0.1 cm.

The Trimble GPS Pathfinder® ProXH™ receiver and the GeoXH™ handheld, with H-Star technology, enable subfoot (30 cm) post processed accuracy, and when used with an external Zephyr™ antenna, the receivers are capable of 8 inches (20 cm) or better.

Skyhook Wireless uses something they call XPS, which is a software-only location platform that can quickly determine the location of any Wi-Fi enabled mobile device with an accuracy of 10 to 20 meters. To quickly and reliably arrive at accurate location results, XPS synthesizes data from Skyhook's Wi-Fi Positioning System (WPS), GPS satellites and Cell Towers. WPS determines location based on Skyhook's massive worldwide database of known Wi-Fi hotspots. It performs best where GPS is weakest, in urban areas and indoors. It then uses advanced hybrid positioning algorithms to combine each of these location sources to arrive at a single position with a high degree of confidence. By leveraging the strengths of more than one underlying position technology, XPS provides the best location available to mobile applications and devices today. Skyhook Wireless Inc. has numerous related patents: U.S. Pat. No. 7,433,694: Location beacon database, U.S. Pat. No. 7,414,988: Server for updating location beacon database, U.S. Pat. No. 7,305,245: Location-based services that choose location algorithms based on number of detected Wi-Fi hotspots within range of user device, U.S. Pat. No. 7,403,762: Method and system for building a location beacon database, U.S. Pat. No. 7,502,620: Encoding and compression of a location beacon database, U.S. Pat. No. 7,493,127: Continuous data optimization of new Wi-Fi hotspots in positioning systems, U.S. Pat. No. 7,474,897: Continuous data optimization by filtering and positioning systems, U.S. Pat. No. 7,471,954: Methods and systems for estimating a user position in a WLAN positioning system based on user assigned Wi-Fi hotspot locations, U.S. Pat. No. 7,515,578: Estimation of positioning using WLAN Wi-Fi hotspot radio propagation characteristics in a WLAN positioning system, U.S. Pat. No. 7,551,579: Calculation of quality of WLAN Wi-Fi hotspot characterization for use in a WLAN positioning system, and U.S. Pat. No. 7,551,929: Estimation of speed and direction of travel in a WLAN positioning system using multiple position estimations. These patents are incorporated herein by reference in their entirety.

The accuracy available today via GPS and Wi-Fi described above, allows GPS and Wi-Fi devices to determine and record precise real time geographic locations of mobile devices in vehicles. A predominant trend in positioning systems is toward an increase in accuracy. This increased accuracy allows for the creation of new methods and systems using GPS.

C) Waypoints and Wi-Fi Hotspots

A waypoint is a reference point in physical space used for purposes of navigation. Waypoints are sets of coordinates (latitudes and longitudes) that identify points in physical space. Waypoints have only become widespread for navigational use by the layman since the development of advanced navigational systems, such as GPS and certain other types of navigation. Waypoints located on the surface of the Earth are usually defined in two dimensions (e.g., longitude and latitude); waypoints used in the Earth's atmosphere or in outer space are defined in at least three dimensions (four if time is one of the coordinates, as it might be for some waypoints outside the Earth).

In the modern world, waypoints are increasingly abstract, often having no obvious relationship to any distinctive features of the real world. These waypoints are used to help define invisible routing paths for navigation. Abstract waypoints of this kind have been made practical by modern navigation technologies, such as land-based radio beacons and the satellite-based GPS. Abstract waypoints typically have only specified longitude and latitude or UTM coordinates, and often a name if they are marked on charts, and are located using a radio navigation system such as a VOR or GPS receiver. A waypoint can be a destination, a fix along a planned course used to make a journey, or simply a point of reference useful for navigation. GPS systems and/or devices are increasingly used to create and use waypoints in navigation of all kinds.

Waypoints can also be marked on a computer mapping program and uploaded to a GPS receiver, marked on the receiver's own internal map, or entered manually on the device as a pair of coordinates. Waypoints can be used to help define invisible routing paths for navigation. Waypoints can also be part of commercial collections, especially those that ship with digital maps, or that are sold on a subscription basis like Navteq and Teleatlas.

Many GPS receivers, both military and civilian, now offer integrated cartographic databases (also known as base maps), allowing users to locate a point on a map and define it as a waypoint. Some GPS systems intended for automobile navigation can generate a suggested driving route between two waypoints, based on the cartographic database.

Most GPS receivers allow the user to assign numerous attributes to each waypoint. Many models also let the user select a symbol or icon to identify the waypoint on a graphical map display from a built-in library of icons. These include standard map symbols for marine navigation aids such as buoys, marinas and anchorages, as well as such land-based symbols as churches, bridges, shopping centers, parks, tunnels etc. Toll plazas are often not included.

Typically a Wi-Fi hotspot is a physical location that offers internet access over a wireless LAN through the use of a shared internet connection and a single router. Wi-Fi hotspots are sometimes referred to as wireless access points or wireless networks open to the public. Wi-Fi hotspots can often be found in coffee shops, restaurants, bowling alleys and various other public places throughout much of North America and Europe. Many business models have emerged for Wi-Fi hotspots. The final structure of the Wi-Fi hotspot marketplace will ultimately have to consider the intellectual property rights of the early movers; portfolios of more than 1,000 allowed and pending patent claims are held by some of these parties.

Location-based services are an emerging area of mobile applications that leverages the ability of new devices to calculate their current geographic position and report that to a user or to a service. Some examples of these services include local weather, traffic updates, driving directions, child trackers, buddy finders and urban concierge services. These new location sensitive devices rely on a variety of technologies that all use the same general concept. Using radio signals coming from known reference points, these devices can mathematically calculate the user's position relative to these reference points. Each of these approaches has its strengths and weaknesses based on the radio technology and the positioning algorithms they employ.

Performance and reliability of the underlying positioning system are the key drivers to the successful deployment of any location based service. Performance refers to the accuracy levels that the system achieves for that given use case. Reliability refers to the percentage of time that the desired performance levels are achieved.

D) Geocoding

Geocoding is described in U.S. Pat. No. 6,101,496 issued on Aug. 8, 2000, which patent is incorporated herein by reference in its entirety. In the context of spatially meaningful databases, geocoding is the act, method or process of assigning x and y coordinates (usually but not limited to latitude and longitude) to records, lists and files containing location information (full addresses, partial addresses, zip codes, census FIPS codes, etc.) for cartographic or any other form of spatial analysis or reference.

Geocoding is often performed by running ungeocoded (referred to hereafter as "raw data") information such as a list of customers through software and/or data which performs table lookup, fuzzy logic and address matching against an entire "library" of all known or available addresses (referred to hereafter as "georeferenced library") with associated x, y location coordinates. Since toll plazas do not have addresses they cannot be automatically geocoded.

Various technologies for providing location information include triangulation using radio signals, GPS, and other technologies described in U.S. Pat. Nos. 5,528,248 and 6,477,379. U.S. patent application Ser. No. 10/159,195 filed on May 31, 2002 discloses a method and system for obtaining geocodes corresponding to addresses and addresses corresponding to geocodes. This application claims the benefit of the disclosure and filing date of U.S. Provisional Patent Application No. 60/256,103 filed on May 31, 2001. These patent applications are also incorporated herein by reference in their entirety. These and other means for determining geographical position, including those developed subsequent to this invention, may be used to provide location information.

Locations may be specified by various means, both actual and representational, including geocodes, centroids, and street vectors/segments. These and other terms may be used by various technologies to provide systems and methods for delivering spatially dependent services such as paying tolls electronically.

E) Navigation Systems

Navigational systems, defined as systems that provide a unit's local position and a way of planning a course around the unit's local position, sometimes to a remote position, such as in-vehicle navigations systems do, are well known in the art. Typically, an in-vehicle navigation system consists of a display screen, processing unit, storage unit, and user input mechanism. The storage system typically contains, for example, maps and travel information used for navigational purposes. Travel information may include such items as waypoints and/or points of interest (POIs), local restaurants, theaters, municipality locations, and the like. These navigational systems do not currently include toll locations.

There are numerous mobile devices that can function as navigation systems because they either have a GPS chip inside or are able to connect to a GPS receiver. Examples of these devices include but are not limited to GPS navigation devices such as those made by Garmin, Magellan, Navigon and TomTom etc., cell/mobile phone devices, PDAs, music, video players and laptop computers.

F) Communications Systems

A communications system provides the functionality to provide wireless mobile device users directional information to a desired destination. Incorporated into a wireless mobile device is a position-determining device such as a GPS device. U.S. Pat. No. 5,815,814 is a cellular telephone system that uses the position of a mobile unit to make call management decisions, held by Dennison, et al., and is hereby incorporated herein in its entirety. The geographic location of the mobile unit is precisely determined using triangulation, a NAVSTAR global positioning system, or its equivalent. Each mobile unit includes a GPS receiver that receives information from a geostationary satellite to determine the precise location of the mobile unit. When a phone user establishes a connection with a particular switch in the wireless network, this positional information from the GPS device is provided and the exact location of the wireless device may be determined.

Advances in telecommunications technology have enabled faster and more accurate location of users carrying mobile devices. Examples of such technology are described in U.S. Pat. Nos. 6,477,362 and 6,477,379, both issued on Nov. 5, 2002, which patents are incorporated herein by reference in their entirety. These patents respectively describe systems for directing emergency services to a user based on her or his location and for locating a mobile device with the aid of two or more cell sites. U.S. Pat. No. 7,397,424 describes a system and method for enabling continuous geographic location estimation for wireless computing devices. The system and methods in this patent combine GPS, WiFi, and cellular technologies in order to determine super-accurate location information. U.S. Pat. No. 7,397,424 is hereby herein by reference in its entirety.

In 2008 the US cellular market is estimated at around 250-300 million devices and this number is growing at over 10% per year. Europe already has over 400 million cell phone users, and the global market is over 2.0 billion devices. Cell phone carriers are constantly looking for opportunities to both increase revenue and profits by providing new services. Some cellular phones now provide Internet access allowing the use of Internet applications, including browsers to allow access to Internet web pages from the phone.

U.S. Pat. No. 7,333,820, held by Networks In Motion, Inc., describes a system and method for providing routing, mapping, and relative position information to users of a communication network. It describes a system that determines local and/or remote position information which does not require an extensive collection of DVD or CD-ROM discs, which is able to provide location and destination address or position information given a telephone number, and which is up-to-date and reliable and can be accessed via a networked online server(s). Additionally, this patent is for a system that determines local and/or remote position information of devices that are not always associated by telephone numbers, but IP addresses or the like, and which can obtain such position information instantaneously and share it, by means of authentication and authorization protocols, without requiring any prior configuration. U.S. Pat. No. 7,333,820 is hereby incorporated herein in its entirety.

In Helsinki, Finland on Sep. 17, 2009 a company named GloPos issued a press release stating that they have patent pending software-only positioning technology that makes all mobile phones location aware—outdoors, indoors, and even underground. They go on to state that their technology only requires a cellular network communication system and that no additional hardware like GPS or W-LAN is required. GloPos' patent pending self learning algorithms claim to calculate an accurate position fix to within 1 to 40 meters in places where no W-LAN Wi-Fi hotspots are available or no GPS can be used. This new technology enables operator-independent positioning for mobile devices anywhere a GSM network is available. Until this announcement, positioning applications were only capable of serving less than half of the 2009 yearly 1.3 billion unit mobile market. GloPos' pending patent is herby incorporated herein in its entirety.

A number of patents have been issued for highway toll collection systems, for example, U.S. Pat. No. 5,490,079 Issued Feb. 6, 1996, U.S. Pat. No. 5,721,678 Issued Feb. 24, 1998, PCT Patent Application No. PCT/DE00/02487 Filed Jul. 25, 2001, PCT Patent Application No. PCT/DE01/03947 Filed Oct. 16, 2001, U.S. Pat. No. 7,215,255 Issued May 8, 2007, U.S. Pat. No. 7,254,382 Issued Aug. 7, 2007, and U.S. Pat. No. 7,255,264 Issued Aug. 14, 2007, each of which is hereby incorporated herein by reference.

SUMMARY OF THE INVENTION

Since mobile devices can calculate and record how far a vehicle travels from a starting point, ETC could be a function of miles actually driven on the toll road. Therefore tolls need not be a function of the specific toll plaza(s) passed. Those drivers that pay a toll soon after they enter a toll road, or those that pay a toll just before exiting, would be able to pay a fairer toll rate if their mobile device was their toll collector because the mobile device could record the history of the actual mileage driven and the user would only pay for the miles driven. A certain segment of commuters that now avoid toll roads might now start using them. In the future this concept would help minimize the need for toll plazas.

Currently there are no systems and/or methods that combine the areas of Electronic Toll Collection, Global Position Systems, Waypoints and Wi-Fi hotspots, Geocoding, Navigational Systems and Communications Systems mentioned above to determine the real time position of a vehicle containing a wireless mobile device relative to "virtual" toll locations for paying tolls via communication networks and mobile devices. If such services and/or systems and methods existed, this mode of electronic toll collection would help toll authorities quickly increase the number of electronic toll users, which is their stated mission. If such services and/or systems and methods of toll collection existed it would help minimize the cost, time and inconvenience associated with the distribution of traditional toll collection devices as well as the inconvenience associated with account set up. In addition, it would eliminate the need to attach a transponder and/or tag to the inside of the windshield of a vehicle. It would also eliminate the need for customers to purchase a transponder and/or tag, in order for them to take advantage of the benefits that electronic toll collection provides. If such services and/or systems and methods of toll collection existed, tolls could be based on how far you actually drive not on the specific toll locations passed. Another added benefit would be to help reduce new toll road infrastructure expense such as inner city congestion zones to help minimize traffic in heavily congested areas. New toll roads and/or congestion zones could easily and accurately be created using "virtual" toll locations. Another benefit would be to help minimize congestion/carbon emissions by helping even more consumers pay tolls electronically instead of having to stop and pay tolls. Also, toll plazas are typically wider than the rest of the highway; reducing the need for them makes it possible to fit toll roads into tight corridors. There are numerous benefits and a need for a fast and convenient method for subscribing to, activating, and paying tolls via wireless mobile devices.

In light of the above, it will be apparent that a need exists in the art to provide a fast, convenient and cost effective process for subscribing to, activating, and paying tolls electronically via wireless mobile devices by using "virtual" toll locations and/or "virtual" toll barriers and/or "virtual" toll boundaries. It is therefore an object of the invention to provide systems and methods that provide electronic toll collection that is fast, convenient and cost effective to the user.

It is another object of the invention to incorporate the use of one or more waypoints to define "virtual" toll locations and/or "virtual" toll barriers and/or "virtual" toll boundaries by recording highly accurate waypoints that correspond to the actual physical locations of toll plazas, toll bridges, toll tunnels etc.

It is another object of the invention to incorporate the use of Wi-Fi hotspots to define "virtual" toll locations and/or "virtual" toll barriers and/or "virtual" toll boundaries by creating toll locations using Wi-Fi hotspots that correspond to the actual physical locations of toll plazas, toll bridges, toll tunnels etc.

It is another object of the invention to facilitate the ability of the mobile devices to sense when they are approaching a "virtual" toll locations and/or a "virtual" toll barriers and/or "virtual" boundaries and when they have passed them.

It is another object of the invention to provide an automated system and method of electronic toll collection via mobile device applications and/or services by providing accurate real-time position information to users of communication networks.

It is another object of the invention to provide a means to determine how many miles a vehicle has driven on a toll road so that ETC could be a function of miles actually driven instead of the specific toll plazas passed.

It is another object of the invention to provide users self-service management of their accounts via their mobile devices, the Internet and/or private network server(s).

It is another object of the invention to provide the methods and systems that use "virtual" toll locations and/or "virtual" toll barriers and/or "virtual" boundaries to implement an open road tolling system by subscribing to a service that has incorporated such methods and systems.

It is another object of the invention to establish and/or create a regional, national and/or international database of "virtual" toll locations and/or "virtual" toll barriers and/or "virtual" boundaries to become part of commercial collections; especially those that ship with digital maps, or that are sold on a subscription basis.

It is another object of the invention for the mobile device to incorporate the use of RFID or related technologies for the purposes of identification and tracking of the vehicle and the user of the vehicle, such that the mobile device may be used by governmental agencies for vehicle registration, vehicle tracking (EVI) and other purposes beyond toll collection.

It is another object of the invention to provide systems and methods of electronic toll collection via wireless mobile device applications and/or services that help minimize the need for the cost, time and inconvenience associated with traditional toll collection device distribution, and the inconvenience of account set up. And to reduce the need to maintain a fair number of lanes for cash collection tolls.

It is another object of the invention to provide methods and systems of electronic toll collection via wireless mobile device applications and/or services that eliminate the need to attach a transponder and/or tag to the inside of the windshield of a vehicle.

It is another object of the invention to provide systems and methods of electronic toll collection via wireless mobile device applications and/or services that eliminate the need for customers to make an advance purchase a transponder and/or tag to take advantage of the benefits that electronic toll collection provides.

It is another object of the invention to provide systems and methods of electronic toll collection via wireless mobile device software applications and/or services in conjunction with location based systems (LBS) to collect tolls and fees on a as daily, weekly and monthly and/or on a per toll location passed transaction basis and/or based on miles driven, during a specified period(s) of time and/or on an unlimited time basis.

It is another object of the invention to provide methods and systems of electronic toll collection via wireless mobile device software applications and/or services that allow the user to activate the toll collection service and/or deactivate the toll collection service.

It is another object of the invention to provide systems and methods of ETC via wireless mobile device software applications and/or services that are linked via a network to a centralized server(s), such as via the Internet, for the purposes of identification and tracking of the vehicle and the user of the vehicle, such that the wireless mobile device may be used by governmental agencies for vehicle identification, vehicle tracking and other purposes beyond toll collection.

It is another object of the invention to provide systems and methods of electronic toll collection via wireless mobile device applications and/or services that establish billing accounts and accept payment in multiple forms.

It is another object of the invention to determine via a central server(s) and/or virtual cloud server(s) (CS) whether the motorist and/or subscriber has activated and/or deactivated an ETC service associated with the mobile device in the vehicle.

It is another object of the invention to provide a means for sending a charge transaction from the CS to a service provider(s), third party(s) and/or toll authority(s) that are linked with an ETC system, the charge transaction indicating that the toll has not been paid by the motorist and/or subscriber.

It is another object of the invention to provide a means for generating a billing record for the motorist and/or subscriber at the CS and sending a non-charge transaction from the CS to an ETC system, the non-charge transaction indicating that the toll has been billed to the motorist and/or subscriber via the service provider of the motorist and/or subscriber.

It is still another object of the invention to provide a confirmation (SMS or text, vibration, voice, audible alert, email, etc.) to the mobile device and/or subscriber indicating the amount paid and current status of the account.

It is still another object of the invention to provide a confirmation (SMS or text, vibration, voice, audible alert, email, etc.) to the mobile device indicating that the user has entered a toll road with the electronic toll collection service deactivated and that they may incur violations if they pass any toll locations.

It is still another object of the invention to incorporate systems and electronic toll collection methods via wireless mobile device applications and/or services that can link to a server(s) providing a fully-interactive, real-time, linkage (via terrestrial, cell towers, wireless Internet, radio or satellite communication) to permit users to view the status of their toll charges and manage their account.

It is yet another object of the invention to provide systems and methods of electronic toll collection via wireless mobile device applications and/or services which can be used to implement an open road tolling system.

Still further advantages and benefits of the present invention will become apparent to those of ordinary skill in the art upon reading and understanding the present specification.

To achieve the above and other objects, the present invention is directed to a method of processing ETC for a motorist and/or subscriber having a mobile device linked to one or more specific vehicle(s) and billing account(s) with a service provider(s), third party(s) and/or toll authority(s). The method includes determining when the motorist having the mobile device in their vehicle approaches and passes a "virtual" toll location and/or "virtual" toll barrier and/or "virtual" toll boundary having a given toll that is to be paid by the motorist and/or subscriber; determining via a CS whether the motorist and/or subscriber has activated an electronic toll collection payment service associated with the mobile device; sending a charge transaction from the CS to a service provider(s), third party(s) and/or directly to a toll authority(s) system, the charge transaction indicating that the toll has not been paid by the motorist and/or subscriber; and generating a billing record for the motorist and/or subscriber at the CS and sending a non-charge transaction from the CS to a service provider(s) and or third party(s) and/or directly to a toll authority(s) system, the non-charge transaction indicating that the toll has been billed to the motorist and/or subscriber via the service provider(s) and/or third party(s) of the motorist and/or subscriber. In preferred embodiments, after every transaction, a confirmation (SMS or text, vibration, voice, audible alert, email, etc.) is sent to the wireless mobile device and/or subscriber indicating the amount paid and/or billed and the current status of the account.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

FIG. 12 is an exemplary architecture of positioning software used in conjunction with Wi-Fi hotspots.

FIGS. 16, 17, 18 and 19 combined form an exemplary diagram of an objects model that describes the components of a location based application.

DETAILED DESCRIPTION OF THE INVENTION

It is to be understood that the specific methods and systems illustrated in the attached drawings and described in the following specification are simply examples of the inventive concepts defined in the claims. Therefore, specific examples and characteristics related to the embodiments disclosed herein are not to be considered as limiting, unless the claims expressly state otherwise.

Figure 1:
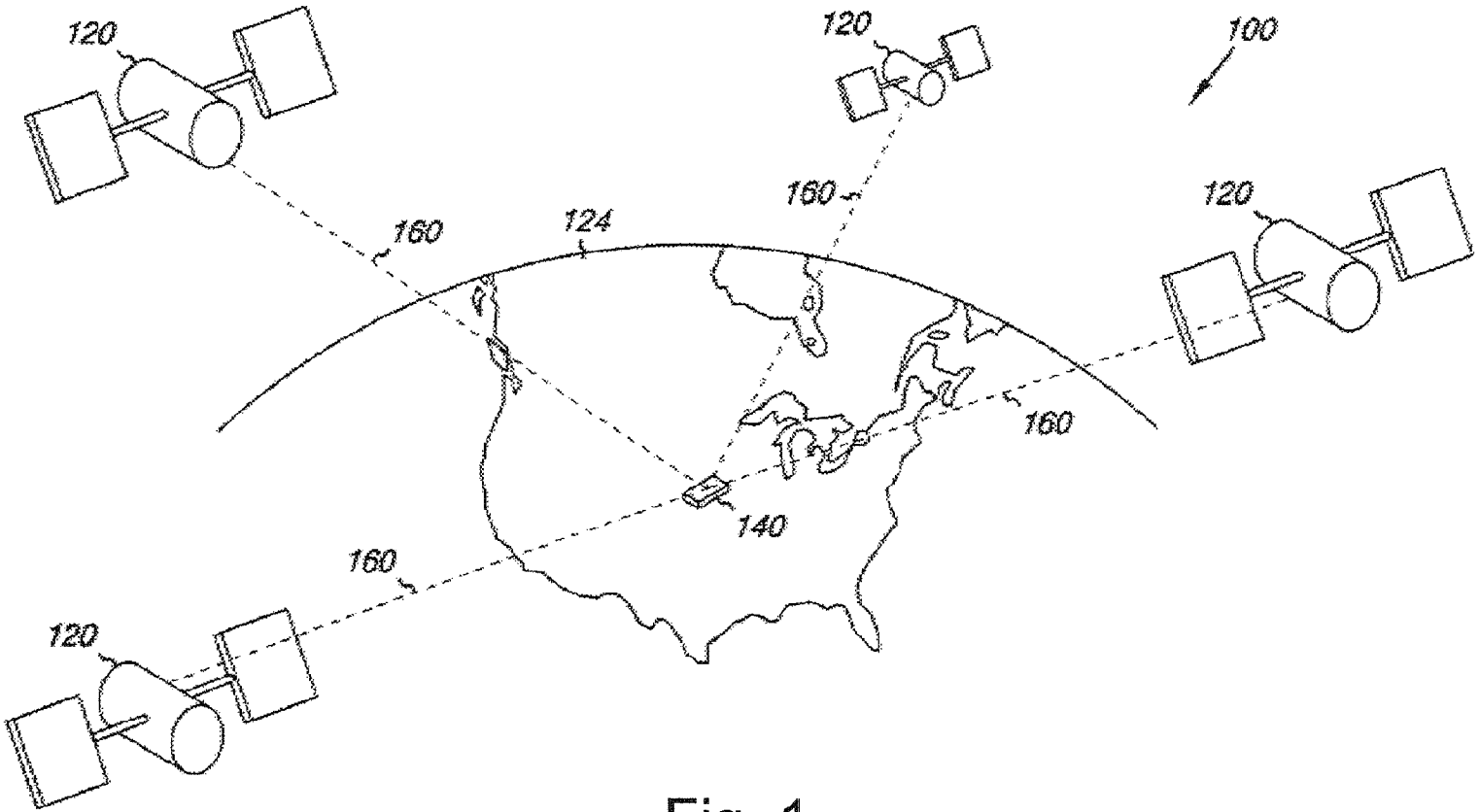
Fig. 1 (PRIOR ART)
FIG. 1 is a representative view of prior art a Global Positioning System (GPS).

FIG. 1 is representative of a GPS denoted generally by reference numeral (100). Pluralities of satellites (120) are in orbit about the Earth (124). The orbit of each satellite (120) is not necessarily synchronous with the orbits of other satellites (120) and, in fact, is likely asynchronous. A GPS receiver device (140) of the present embodiment is shown receiving spread spectrum GPS satellite signals (160) from the various satellites (120).

The spread spectrum signals (160) continuously transmitted from each satellite (120) utilize a highly accurate frequency standard accomplished with an extremely accurate atomic clock. Each satellite (120), as part of its data signal transmission (160), transmits a data stream indicative of that particular satellite (120). It will be appreciated by those skilled in the relevant art that the GPS receiver device (140) must acquire spread spectrum GPS satellite signals (160) from at least three satellites (120) for the GPS receiver device (140) to calculate its two-dimensional position by triangulation. Acquisition of an additional signal (160), resulting in signals (160) from a total of four satellites (120), permits GPS receiver device (140) to calculate its three-dimensional position.

The GPS receiver communicates with the satellites and the longitude and latitude of the mobile unit are determined.

Figure 2:
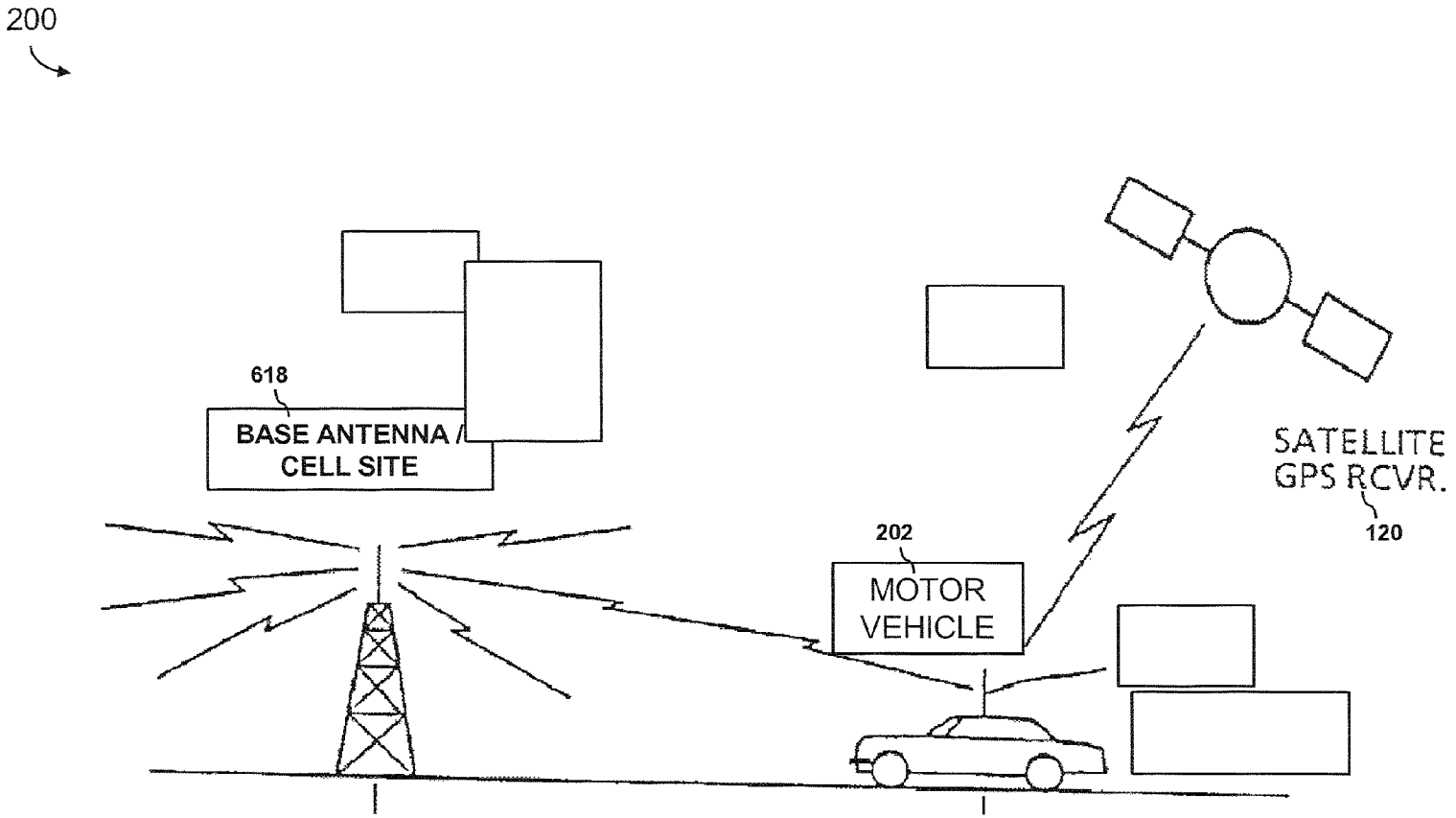
Fig. 2 (PRIOR ART)
FIG. 2 illustrates a typical prior art cellular system in which a mobile unit can be connected with a fixed-position unit. It also illustrates a Wi-Fi hotspot that may be detected by positioning software inside the user's mobile device inside the motor vehicle.

FIG. 2 shows a cellular system in which a mobile unit can be connected with a fixed-position unit. It also shows a Wi-Fi hotspot (402) which can be detected by positioning software inside the user's mobile device inside the motor vehicle (202).

Figure 3:
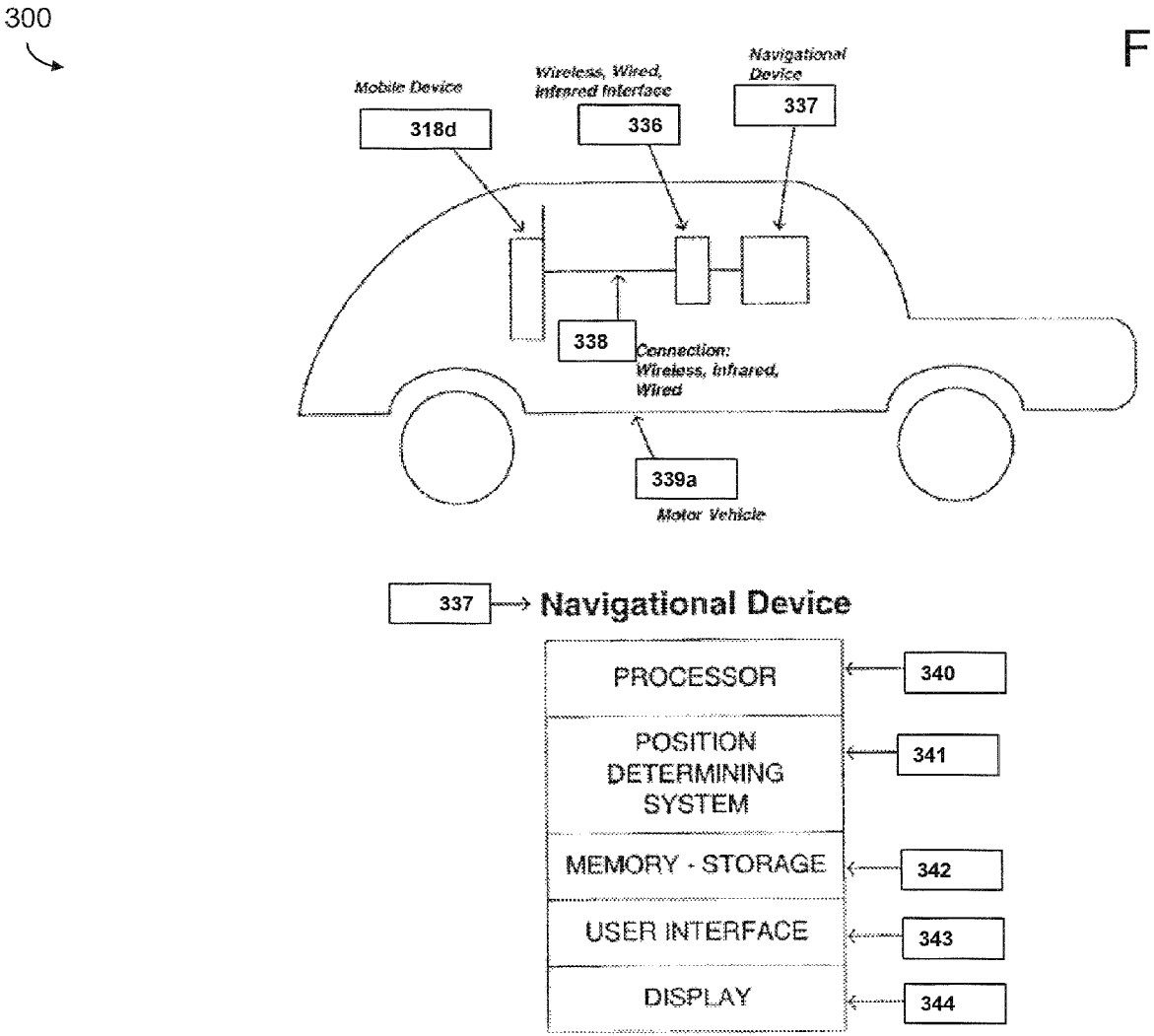
Fig. 3 (PRIOR ART)
FIG. 3 illustrates a prior art system using a mobile telephone to obtain position information of the remote device and possibly the local device's position information and then pass that information to another more capable processing and/or display device such as an in-vehicle navigation system via some form of wired, wireless, or infrared connection to process and/or display the data.

Using a mobile device (318*d*), as illustrated in FIG. 3, it is possible to obtain the unit's real time local position and a destination position for the purpose of navigation. However, some mobile navigational devices (318*d*), such as a cellular phones or wireless PDAs, do not possess all of the capabilities or are not optimal for navigational purposes. An accompanying device (337), such as an in-vehicle navigational device usually installed in a motor vehicle (339*a*), is currently better suited for navigational displays and computations. In one embodiment, once the mobile device (318*d*) has obtained either the local or remote position information, via a wireless, such as a Bluetooth or 802.11, connection, or a wired, such as a USB or serial, connection, or an infrared or optical connection, it is sent by such connection (338) to a complementary connection interface device (336) that is connected to the navigational device. A typical navigational device contains a processor (340), a position determining system (341), a memory or storage device (342), a user interface (343), a display (344) and positioning software (337*a*). In some embodiments, a user interface (343) and display (344) are combined as a touch sensitive display. Once the position has been obtained, as previously described, the navigational device can utilize this position information to provide typical navigational functionality, such as routing, driving directions, mapped information, etc.

In another embodiment, the mobile device (318*d*) calculates all of the navigational information internally by means of the online databases application server (ODAS) (1301) and passes the information over to another device (337), such as a mobile computer, via a compatible connection interface (336) in order to better display the information. As the mobile device (318*d*) moves, or its position changes, position and/or data information is sent to the navigational device (337), via the interface connection (336) for real-time accurate data updates on the navigational device (337).

One feature of this system is the use of a telephone number to obtain position information associated with the telephone number from a networked online server. The system utilizes an ODAS (1301) to facilitate this function, where the database is updated to improve the accuracy and reliability of the data. Thus if a mobile navigational device (445), such as a PDA, cellular telephone, or mobile computer, requires telephone-to-position information capability, and it does not have wireless connectivity or will travel outside known wireless coverage regions, the mobile navigational device can download a batch of data specific to the geographical region where there is no wireless coverage from the ODAS (1301) when appropriate, thus providing more accurate and reliable data to the user or application requesting this information.

Figure 4:
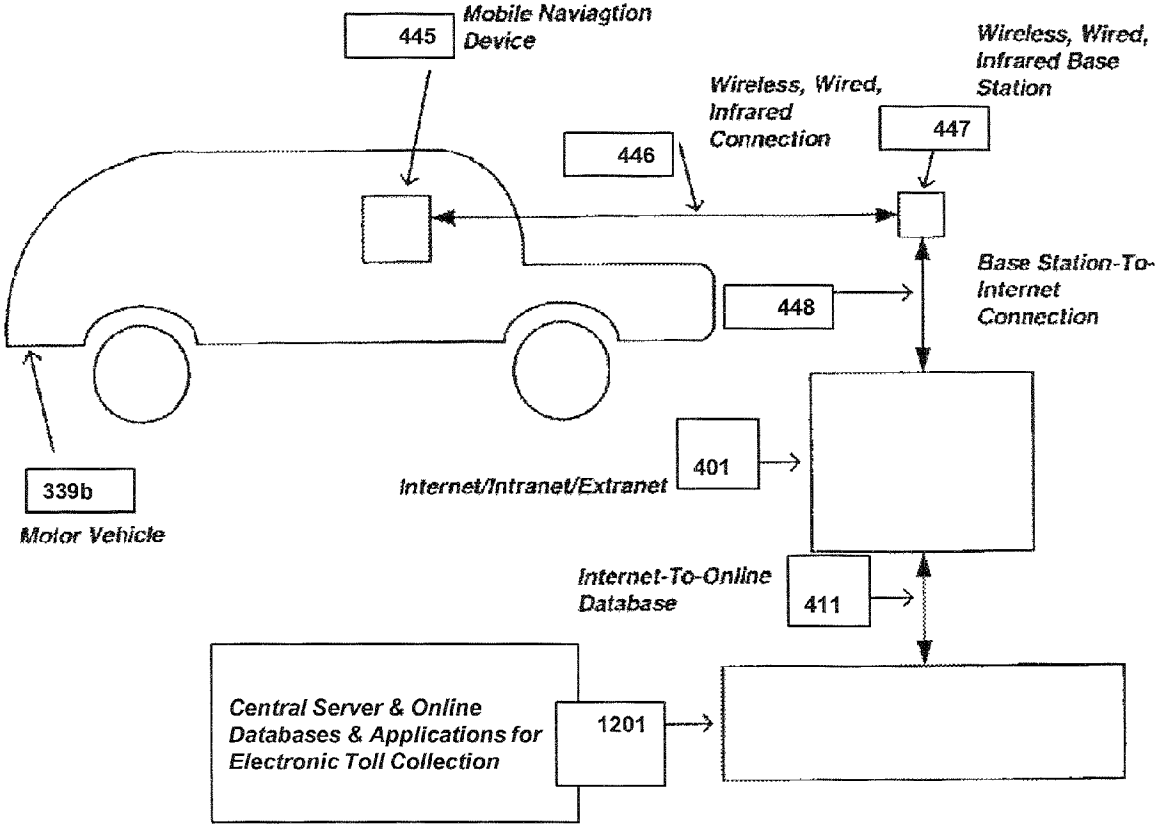
Fig. 4 (PRIOR ART)
FIG. 4 illustrates a prior art system using a wireless connection to download a set of correlated telephone-to-address and/or position dataset information when a wireless connection is not possible or unnecessary. It also illustrates positioning software inside the user's mobile device to detect nearby Wi-Fi hotspots.

In one embodiment, as illustrated in FIG. 4 a motor vehicle (339*b*) contains a mobile navigational device (445), such as a PDA, cellular telephone, or mobile computer in the vehicle. Since the mobile navigational device (445) does not have a wireless connection, it is not possible to connect to the ODAS (1301) while driving. However, the mobile navigational device (445) has a USB port and can download the expected geographical region where the motor vehicle (339*b*) is expected to travel. In this embodiment, the mobile navigational device (445) can connect via a USB cable (446) to a USB hub (447) that has a connection (448) to the Internet, Intranet or Extranet (401) which is connected (411) to the ODAS (1301). The mobile navigational device (445) then downloads all of the data necessary to perform the telephone number to position information calculations while en route, improving the accuracy of the data for this application.

In another embodiment, a motor vehicle (339*b*) contains a mobile navigational device (445), such as a PDA, cellular telephone, or mobile computer, which has wireless connectivity. In this embodiment, the mobile navigational device (445) can obtain telephone number to position information from the ODAS (1301) by connecting through the wireless connection (446) to the wireless network interface (447), which is then connected (448) to the Internet, Intranet or Extranet (401) which is then connected (411) to the ODAS (1301). Having a connection from the mobile navigational device (445) to the ODAS (1301) is dependent on having wireless coverage. If the mobile navigational device (445) is not within a wireless coverage area, the mobile navigational device (445) may be unable to obtain position information given a telephone number because it does not have access to the ODAS (1301). Since wireless coverage is known in advance, it is possible to store the wireless coverage charts on the ODAS (1301) or on the mobile navigational device (445). In one embodiment, the wireless coverage charts are stored on the mobile navigational device (445) and updated when changed. Therefore when the mobile navigational device (445) is traveling inside known wireless regions, the mobile navigational device (445) will extrapolate its course to determine when it will travel outside of wireless coverage. The system will download, or pull, all of the nearby data information along the expected route from the ODAS (1301) until the system is expected to be within a wireless coverage area again.

Figure 5:
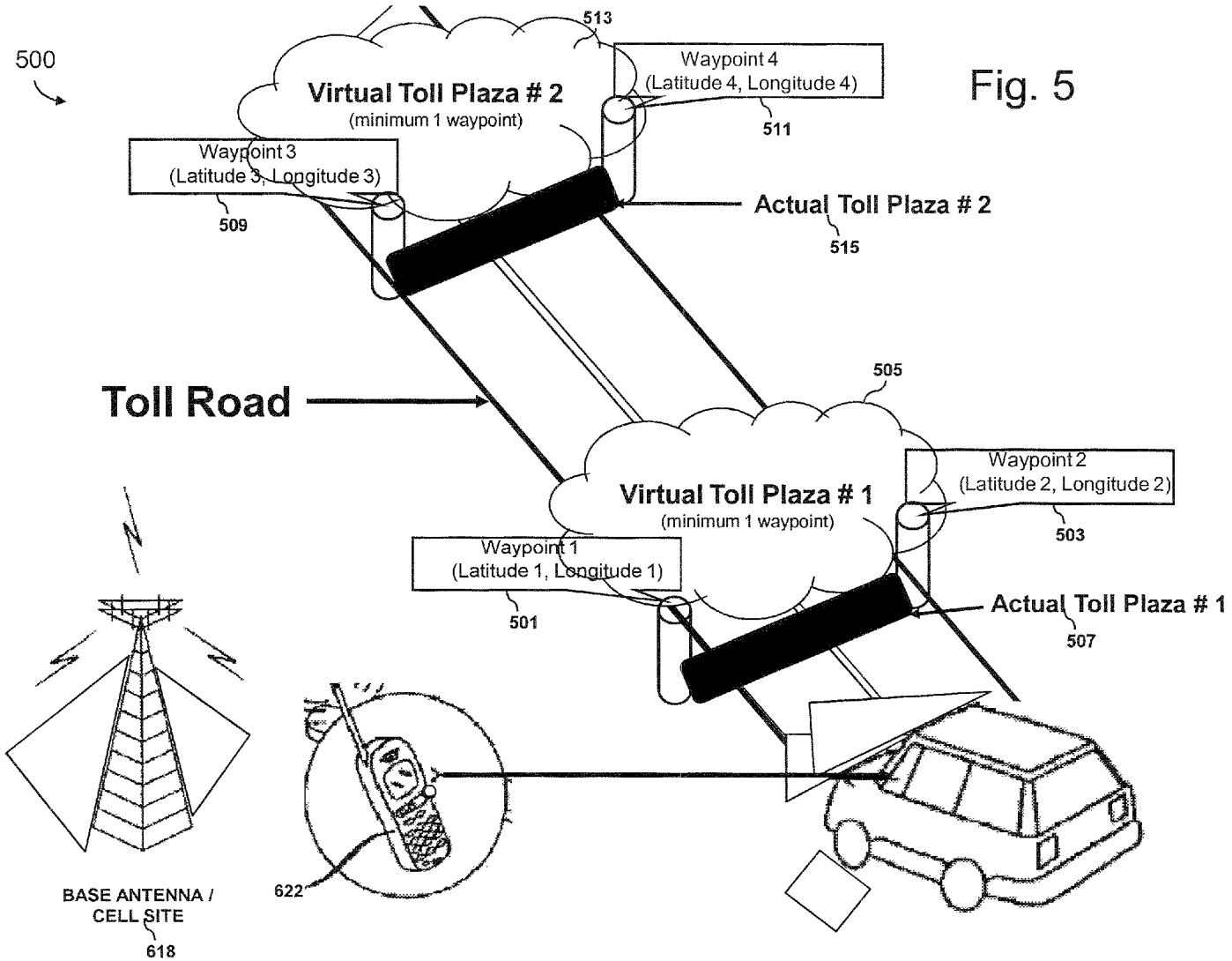
FIG. 5 illustrates an example of "virtual" toll locations and/or "virtual" toll barriers and/or "virtual" boundaries to be used in conjunction with a mobile device in a vehicle.

Using "virtual" toll locations, as illustrated in FIG. 5, the present invention works very similarly to how existing toll locations (toll plazas, toll gates, toll boundaries, etc.) operate. "Virtual" toll locations and/or "virtual" toll barriers and/or "virtual" toll boundaries are defined by one or more waypoints and/or one or more Wi-Fi hotspots associated with a specific toll location. Waypoints are sets of coordinates (latitude and longitude and sometimes altitude) that identify a point in physical space. FIG. 5 illustrates this by depicting waypoint 1, defined by latitude 1 and longitude 1 (501) and waypoint 2, defined by latitude 2 and longitude 2 (503), either waypoint 1 or waypoint 2 can define "virtual" toll location #1 (505). If both waypoint 1 and waypoint 2 are used in tandem they form a "virtual" toll barrier (501 and 503) and/or all or a portion of a "virtual" toll boundary, which is an imaginary path that may be used as a surrogate for the actual physical toll location #1 (507). Similarly, waypoint (509) or waypoint (511) may be used to define "virtual" toll location #2 (513). If both waypoints (509) and (511) are used in tandem they can form a "virtual" toll barrier (509 and 511) and/or all or a portion of a "virtual" toll boundary, which is an imaginary path that may be used as a surrogate for the actual physical toll location #2 (515). If all waypoints (501,503, 509,511) are used in tandem with one another they would form a "virtual" toll boundary around designated congested areas in metropolitan areas. In all the cases cited above Wi-Fi hotspots (402) may be used in lieu of waypoints and/or in addition to waypoints to define "virtual" toll locations and/or "virtual" barriers and/or "virtual" toll boundaries.

Once the "virtual" toll locations have been defined there are several ways of determining when a vehicle (202) containing a mobile device (622) passes a "virtual" toll location. The principle ways discussed here include: Wi-Fi hotspots, Waypoints and a Cellular network communication system without either Wi-Fi and/or GPS.

When Wi-Fi hotspots are used, a vehicle (202) containing a mobile-device (622) having a Wi-Fi radio may be located. A reference database of "virtual" toll locations Wi-Fi hotspots (617) is provided. In response to a user application request to determine a location of a mobile-device having a Wi-Fi radio, the Wi-Fi device is triggered to transmit a request to all Wi-Fi hotspots ("virtual" toll locations) within range of the Wi-Fi device. Messages are received from the Wi-Fi hotspots ("virtual" toll locations) within range of the Wi-Fi device, each message identifying the Wi-Fi hotspot ("virtual" toll locations) sending the message. The signal strength of the messages received by the Wi-Fi hotspots is calculated. The reference database (617) is accessed to obtain the calculated locations for the identified Wi-Fi hotspots ("virtual" toll locations). Based on the number of Wi-Fi hotspots ("virtual" toll locations) identified via received messages, choosing a corresponding location-determination algorithm from a plurality of location-determination algorithms, said chosen algorithm being suited for the number of identified Wi-Fi hotspots ("virtual" toll locations). The calculated locations for the identified Wi-Fi hotspots ("virtual" toll locations) and the signal strengths of said received messages and the chosen location-determination algorithm are used to determine the location of the user-device. Under some circumstances, the plurality of location-determination algorithms includes a simple signal strength weighted average model. Under some circumstances, the plurality of location-determination algorithms includes a nearest neighbor model. Under some circumstances, the plurality of location-determination algorithms includes a triangulation technique. Under some circumstances, the plurality of location-determination algorithms includes an adaptive smoothing technique based on the device velocity. Under some other circumstances, the choice of location-determination algorithm is further based on the user application making the location request.

When waypoints (latitudes and longitudes) are used to define "virtual" locations using latitude and longitude, The Global Positioning System (GPS) is used to determine the location of the mobile device (622). GPS is a satellite-based navigation system made up of a network of 24 satellites placed into orbit by the U.S. Department of Defense. GPS was originally intended for military applications, but in the 1980s, the government made the system available for civilian use. GPS works in any weather conditions, anywhere in the world, 24 hours a day. There are no subscription fees or setup charges to use GPS.

GPS works using satellites that circle the earth twice a day in a very precise orbit and transmit signal information to earth. GPS receivers inside the mobile device (622) take this information and use triangulation to calculate the user's location. Essentially, the GPS receiver compares the time a signal was transmitted by a satellite with the time it was received. The time difference tells the GPS receiver how far away the satellite is. Now, with distance measurements from a few more satellites, the receiver can determine the user's position and display it on the unit's electronic map.

A GPS receiver inside the mobile device (622) must be locked on to the signal of at least three satellites to calculate a 2D position (latitude and longitude) and track movement. With four or more satellites in view, the receiver can determine the user's 3D position (latitude, longitude and altitude). Once the user's position has been determined, the GPS unit can calculate other information, such as speed, bearing, track, trip distance, distance to destination, sunrise and sunset time and more.

A GPS receiver inside the mobile device (622) can also be combined with navigation devices that provide mapping information. In these navigation devices, the location of the device, as determined by the GPS, is shown in relation to "virtual" toll locations, "virtual" toll barriers and/or "virtual" toll boundaries, on a display screen of the device. This cartographic data can be supplied to the navigation device through, for example, via a "virtual" toll location database that is stored in the device.

Again when waypoints are used to define "virtual" locations using latitude and longitude, cell tower triangulation is another method used by wireless and cellular carriers to determine a user or mobile device (622) location. The wireless network and the mobile device communicate with each other to share signal information that the network can use to calculate the location of the device.

Assisted GPS is a newer model that combines both the GPS and cellular tower techniques described above to produce a more accurate and reliable location calculation for the mobile device (622). In this model, the wireless network attempts to help GPS improve its signal reception by transmitting information about the clock offsets of the GPS satellites and the general location of the mobile device (622) based on the location of the connected cell tower.

When only a GSM cellular network is used, some form of GloPos' patent pending self learning algorithms will be used to calculate an accurate position fix to within 1 to 40 meters even in places where no Wi-Fi hotspots are available or no GPS can be used.

When and if newer systems and methods are invented to track the location of a mobile device (622), they may also be used in conjunction with "virtual" toll locations, "virtual" toll barriers and/or "virtual" toll boundaries.

In all three methods (Wi-Fi hotspots, Waypoints and Cellular Network), a vehicle (202) containing a mobile device (622) that is linked to the vehicle via an identification number, such as the vehicle's license plate number, approaches a "virtual" toll location and/or "virtual" toll barrier and/o "virtual" toll boundary, which is in the same physical position as the actual toll location, and as the vehicle passes the "virtual" toll location and/or "virtual" toll barrier and/or "virtual" toll boundary, representing the actual toll location, the motorist and/or subscriber is charged the appropriate toll, provided the motorist and/or subscriber has activated the ETC service (step 715) before passing the "virtual" toll location and/or "virtual" toll barrier and/or the "virtual" toll boundary. The cell site (618) is generally a transmitter/receiver that maintains communications with the wireless mobile device (622) within a given range. The cell site (618) is coupled to a CS (612), which is generally a server(s) that provides services and coordination between mobile users in a network and external networks.

Figure 6:
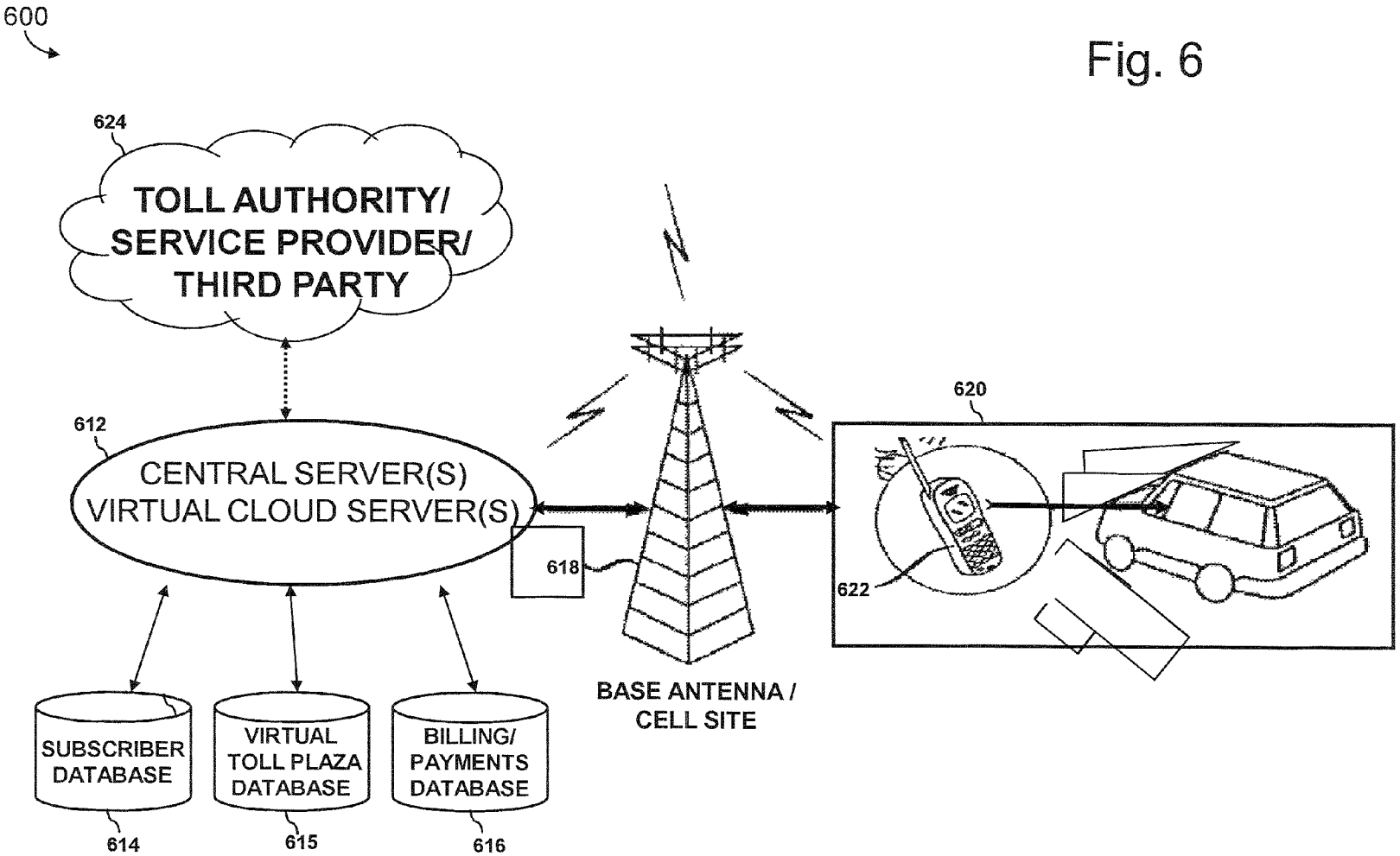
FIG. 6 is a block diagram showing a wireless communication environment suitable for practicing aspects of the present invention.

FIG. 6 is a block diagram of a communication network (600) in which the present invention may be implemented. The network (600) preferably includes one or more CS (612), a billing and/or payments database (616), a subscriber database (614), a cell site or base transceiver station (618), a "virtual" toll location database (latitudes and longitudes) (615), a "virtual toll location database (Wi-Fi hotspots) (617), a wireless mobile device (622), and a toll authority/service provider/third party (624). It is to be understood, however, that the network (600) may incorporate other elements as well.

The cell site (618) is generally a transmitter/receiver that maintains communications with the wireless mobile devices (622) within a given range. The cell site (618) is coupled to CS (612), which is generally a server(s) that provides services and coordination between mobile users in a network and external networks.

The mobile device (622) is generally a wireless device that includes a user interface and an interface for coupling to a radio access network (RAN). The user interface of the mobile device (622) is typically referred to as terminal equipment and generally includes an audio interface, such as a microphone and speakers, a visual interface, such as a display, and a user input interface, such as a keyboard or touch pad. The interface for coupling to the RAN is typically referred to as a mobile terminal and generally includes an over-the-air interface for transmitting and receiving data. The over-the-air interface of mobile device (622) is used to communicate with the cell site (618) in the RAN. The mobile device (622) and the cell site (618) in the RAN may communicate over-the-air using various transmission methods, including a packet-based protocol.

The toll authority (624) may be a state wide (such as I-PASS), a regional (such as EZ-Pass), or a national and/or international system. Although not shown in the figure, the toll authority (624) may include any number of elements as are known in the art for providing ETC services to subscribers, including subscriber databases, and computer systems for debiting, crediting subscriber accounts based on records created from the mobile devices.

In the preferred embodiment, the CS (612) is a processor-based apparatus with data link interfaces for coupling together as described above and shown in FIG. 6. The CS (612) includes one or more processors that execute programs to implement the functionality described herein and generally associated with wireless systems. The flexibility of this processor-based system permits integration into this system of a wireless ETC method and system in accordance with the present invention.

Figure 7:
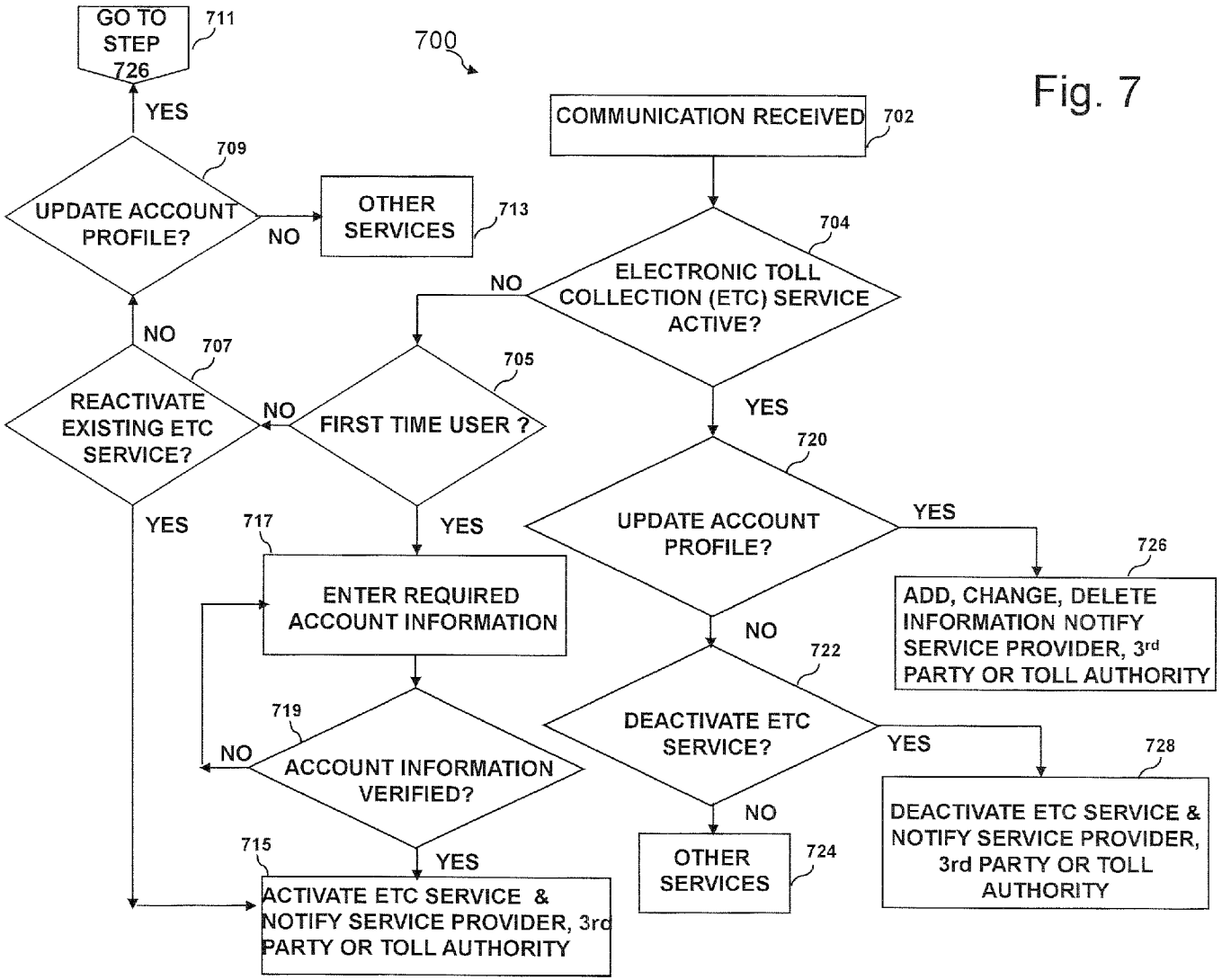
FIG. 7 is a flow chart illustrating a process for handling subscriptions to and/or activations and/or deactivations of a wireless ETC service in accordance with an aspect of the present invention.

With reference now to FIG. 7, a preferred method (700) of subscribing to a wireless ETC service/feature is shown. It is understood that the method (700) may be implemented through software distributed throughout the network (600), or through software in the CS (612).

In (step 702), a communication/signal is received, preferably at the CS (612), from the communication device (622) via the cell site (618). The communication may be initiated in the usual manner, e.g., by dialing a phone number, by entering a feature activation code (e.g., *99), or through an Internet protocol address (which may be obtained from a URL that can be converted to an IP address via a domain name service). The CS (612) recognizes that the communication is from the cell site (618) and then determines whether the communication request is from an active or inactive subscriber to a wireless ETC service (step 704), based upon data contained in the communication. If the request is from an active subscriber, then the network (600), preferably via the CS (612), determines whether the communication request is for updating account data (step 720) in the subscriber database (614) or whether the communication request is for deactivating the account (step 722). If the communication request is for deactivating the account then the network, preferably via the CS (612), changes the account to reflect that the motorist and/or subscriber in question has unsubscribed to the ETC service (step 728). If the communication request is for updating account data then the network, preferably via the CS (612), makes any adds, changes and/or deletions requested and notifies the toll authority (step 726). If the communication request is not for either updating and/or deactivating the account then the network (600), preferably via the CS (612), proceeds to determine what other services, if any, the motorist and/or subscriber is requesting.

Figures 9, 10, 11:
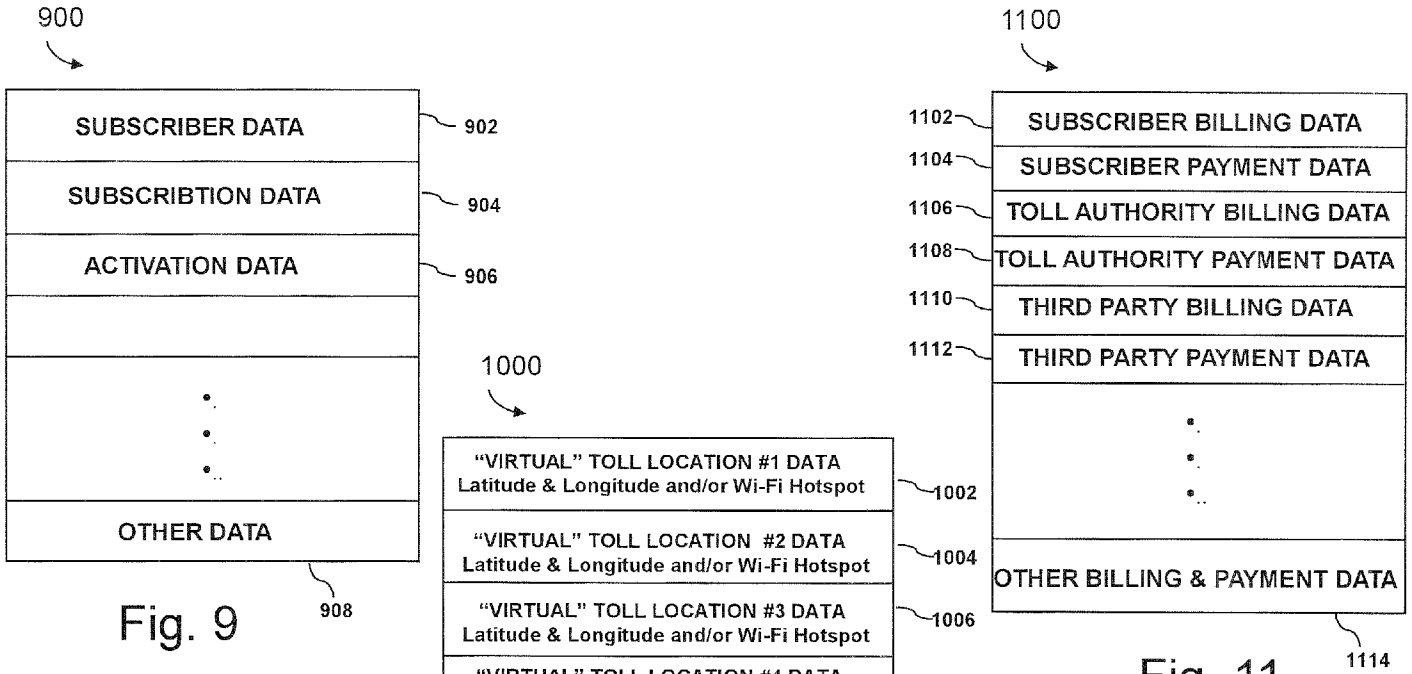
FIG. 9 is memory layout of data stored in the subscriber database in accordance with an aspect of the present invention.
FIG. 10 is memory layout of data stored in the "virtual" toll locations database in accordance with an aspect of the present invention.
FIG. 11 is memory layout of data stored in the billing database in accordance with an aspect of the present invention.

Accordingly, the subscriber database (614) typically includes a number of data sub-blocks for each subscriber. These are shown in FIG. 9. They are shown as a super block (900), not all of whose fields are filled for a particular subscriber. The super block, as known in the art, can be accessed from the identity of any one of several fields in the super block. The super block (900) includes the following data sub-blocks: a block (902) contains basic subscriber data; a block (904) contains ETC service subscription data; and a block (906) contains ETC service activation data. Any number of additional blocks (908) may be provided in the super block (900) for storing additional subscriber data.

Returning now to the method (700), in (step 705), if the communication received is from a first time user then the network (600), preferably via the CS (612), request that the motorist and/or subscriber enter the first time user account information required. First time user account information could require a number of one-time entries, including, but not limited to, providing a credit card for use in the current and future subscriptions, keying in an email address and/or postal address and name, keying in a driver's license number, keying in a license plate number(s), keying in the make(s), model(s) and color(s) of the vehicle(s) (step 717). The first time user information is then verified (step 719). If the first time user information is not verified then the motorist and/or subscriber is asked to reenter the unverified information until it is verified. Once the first time user registration information is verified then the network (600), preferably via the CS (612), activates the new ETC account and notifies the toll authority (step 715) of the new account.

If the communication received is not from a first time user then the network (600), preferably via the CS (612), determines whether the communication request is for reactivating a deactivated existing account (step 707). If yes, then the network (600), preferably via the CS (612) activates the existing account and notifies the toll authority (step 715). If the communication received is not from a first time user then the network (600), preferably via the CS (612), determines whether the communication request is for reactivating a deactivated existing account (step 707). If yes then the network, preferably via the CS (612), activates the existing account and notifies the toll authority (step 715). If no then the network, preferably via CS (612) determines whether the communication request is for updating account data (step 709). If yes, then the network, preferably via the CS (612), makes any additions, changes and/or deletions requested and notifies the toll authority (step 726). If the communication request is not for either updating and/or reactivating the existing account then the network (600), preferably via the CS (612), proceeds to determine what other services, if any, the motorist and/or subscriber is requesting (step 713).

Figure 8:
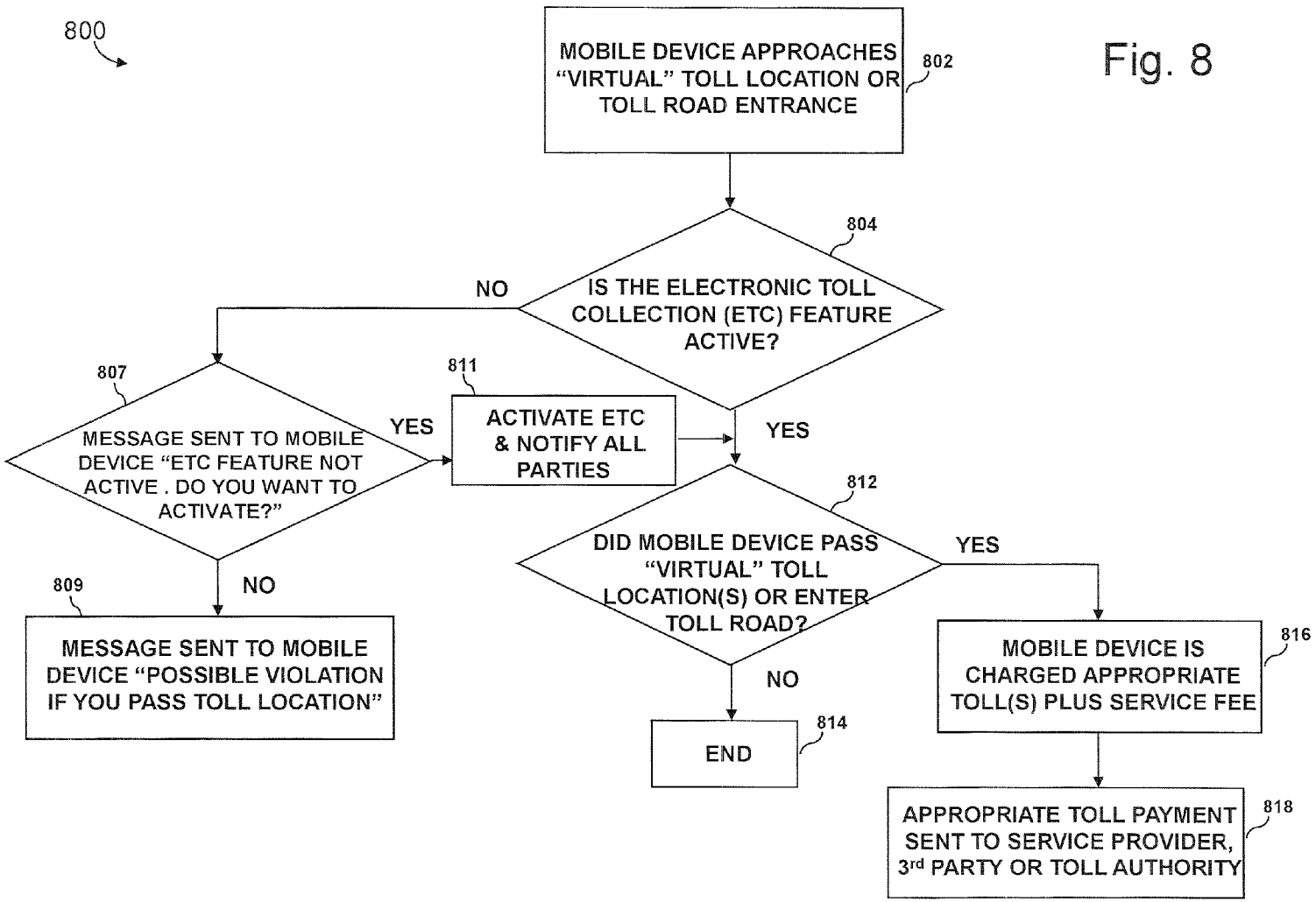
FIG. 8 is a flow chart illustrating a process for implementing the wireless ETC service in accordance with an aspect of the present invention.

With reference now to FIG. 8, a method (800) of implementing the wireless ETC service for a particular motorist and/or subscriber is shown. It is understood that the method (800) may be implemented through software throughout the network (600), but preferably through software in the CS (612).

In (step 802), a wireless subscriber approaches the "virtual" toll location (505). The cell site (618) will automatically communicate with the mobile device (622), if it is turned on. Preferably, the cell site (618) is a dedicated cell site. That is, the cell site (618) has a small RF footprint.

The communication is then transmitted from via the mobile device (622) to the cell site (618) to the CS (612), and a determination is made by the CS (612) as to whether the ETC service is active for the motorist and/or subscriber (step 804). If not, the CS (612) sends a voice or text message to the motorist and/or subscriber's mobile device (622), indicating that the ETC service is not active (step 807). In addition, if the ETC service is not active, the CS (612) sends a voice or text message to the motorist and/or subscriber's mobile device (622), requesting whether or not the motorist and/or subscriber desires to activate the ETC service (step 807). If yes, then the ETC service is activated and the toll authority is notified (step 811). If no, then the CS (612) sends a voice or text message to the motorist and/or subscriber's mobile device indicating that there may be a possible violation if the motorist and/or subscriber proceeds past a toll location (an actual toll plaza, a "virtual" toll location and/or a "virtual" toll barrier) (step 809).

The "virtual" toll location databases (615) and (617) includes an infinite number of data sub-blocks for each "virtual" toll location (either latitude and longitude and/or Wi-Fi hotspot) in their respective toll location databases. These are shown in FIG. 10. They are shown as a super block (1000) not all of whose fields are filled for a particular "virtual" toll location. The super block, as known in the art, can be accessed from the identity of any one of several fields in the super block. The super block (1100) includes a data sub-block (1002), which contains basic data (latitude and longitude or Wi-Fi hotspot, toll charge, etc.) for "virtual" toll location #1, a data sub-block (1104), which contains basic data for "virtual" toll location #2, a data sub-block (1006), which contains basic data for "virtual toll location #3, a sub-block (1008), which contains basic data for "virtual" toll location #4. Any number of sub-blocks (1010) may be provided in the super block (1100) for storing additional "virtual" toll location data.

As the motorist and/or subscriber proceeds past a toll location(s) then the network, preferably via the CS (612) sends the toll charges to the wireless service provider, toll authority and/or a third party for processing (step 816). For example, the subscriber may elect an option in which the subscriber's wireless service provider processes all toll charges; in this case the charges would appear on the subscriber's wireless bill. In that situation, the wireless service provider would send payment to the toll authority on behalf of the subscriber after the subscriber has paid the charges, according to a pre-arranged agreement between the wireless service provider and the toll authority (step 818). In another example, the subscriber may chose a billing option in which all toll charges are processed by a third party, in which case the charges would show up on the third party's bill. In that situation, the third party service would send payment to the toll authority on behalf of the subscriber after the subscriber has paid the charges, according to a pre-arranged agreement between the third party and the toll authority (step 818). In a third example, the subscriber may chose a billing option in which all toll charges are processed by the toll authority, in which case the charges would show up on the toll authority's bill much as is presently done in the I-PASS network and other similar toll collection systems. In that situation, the subscriber would send payment to the toll authority according to a pre-arranged agreement between the subscriber and the toll authority (step 818).

The billing/payments database (616) includes a number of data sub-blocks for each subscriber. These are shown in FIG. 11. They are shown as a super block (1110) not all of whose fields are filled for a particular subscriber. The super block, as known in the art, can be accessed from the identity of any one of several fields in the super block. The super block (1110) includes a data sub-block (1102), which contains basic subscriber billing data, a data sub-block 1104, which contains subscriber payment data a data sub-block 1106, which contains subscriber toll authority billing data, a sub-block (1108), which contains subscriber toll authority payment data, a sub-block (1110), which contains third party billing data, and a sub-block (1112), which contains third party payment data. Any number of sub-blocks (1114) may be provided in the super block (1100) for storing additional subscriber billing and payment data.

The positioning software is described in greater detail with reference to FIG. 12, which depicts exemplary components of positioning software (445*a*). Typically, in the user device there is a software application or service (1201) that utilizes location readings to provide some value to an end user (for example, driving directions). This location application makes a request of the positioning software for the location of the device at that particular moment. The location application can be initiated continuously every elapsed period of time (every 1 second for example) or one time on demand by another application or user.

In FIG. 12, the location application makes a request of the positioning software to interrogate all Wi-Fi hotspots within range at a particular moment and to determine which Wi-Fi hotspots are suspect because the observed data does not correspond to the calculated location in the Reference Database. The information on suspect Wi-Fi hotspots collected by the location application is used to optimize the position information in the Wi-Fi hotspot Reference Database either in real time or at some later time.

In the embodiment depicted in FIG. 12, the location application or service request initiates the scanner (1202), which makes a "scan request" to the 802.11 radio (1203) on the device. The 802.11 radio sends out a probe request to all 802.11 Wi-Fi hotspots (1204) within range. According to the 802.11 protocol, those Wi-Fi hotspots in receipt of a probe request will transmit a broadcast beacon containing information about the Wi-Fi hotspot. That beacon includes the MAC address of the device, the network name, the precise version of the protocol that it supports and its security configuration along with information about how to connect to the device. The 802.11 radio collects this information from each Wi-Fi hotspot that responds, calculates the received signal strength ("RSS") of each Wi-Fi hotspot observed, and sends the identification and RSS information back to the scanner.

The scanner passes this array of Wi-Fi hotspots to the Locator (1206) which checks the MAC addresses of each observed Wi-Fi hotspot against the Wi-Fi hotspot Reference Database (1205). This database can either be located on the device or remotely over a network connection. The Wi-Fi hotspot Reference Database contains the raw 802.11 scanning data plus the calculated location for each Wi-Fi hotspot that is known to the system. The list of observed Wi-Fi hotspots is obtained from the Scanner and the Locator (1206) searches for each Wi-Fi hotspot in the Wi-Fi hotspot Reference Database. For each Wi-Fi hotspot found in the Wi-Fi hotspot Reference Database the recorded location is retrieved. The Locator passes this collection of location information for known Wi-Fi hotspots along with the signal characteristics returned from each Wi-Fi hotspot to the Quality Filter (1207). This filter determines if any of the Wi-Fi hotspots have moved since they were added to the Wi-Fi hotspot Reference Database and works continually to improve the overall system. The Quality Filter marks Wi-Fi hotspots that fail the quality algorithm as "suspect". After removing bad data records, the Filter sends the remaining Wi-Fi hotspots to the Location Calculation component (1208). Using the set of validated reference data from the Wi-Fi hotspot Reference Database and the signal strength readings from the Scanner, the Location Calculation component computes the location of the device at that moment. The Location Calculation component also calculates the position of any newly observed Wi-Fi hotspots not found in the Wi-Fi hotspot Reference Database. The raw scanning data and the location of new Wi-Fi hotspots are stored in the Feedback File (1212). This feedback is either saved locally on the device for later transmission to the server or sent to the server in real time. Before location data for known Wi-Fi hotspots is sent back to the Locator, it is processed by the Smoothing engine (1209) which averages a past series of location readings to remove any erratic readings from the previous calculation. The adjusted location data is then sent back to the Locator.

The calculated location readings produced by the Locator are communicated to these location-based applications (1201) through the Application Interface (1210) which includes an application programming interface (API) or via a virtual GPS capability (1211). GPS receivers communicate their location readings using proprietary messages or using the location standard like the one developed by the National Marine Electronics Association (NMEA). Connecting into the device using a standard interface such as a COM port on the machine retrieves the messages. Certain embodiments of the invention include a virtual GPS capability that allows any GPS compatible application to communicate with this new positioning system without have to alter the communication model or messages.

The location calculations are produced using a series of positioning algorithms intended to turn noisy data flows into reliable and steady location readings. The client software compares the list of observed Wi-Fi hotspots along with their calculated signal strengths to weight the location of user to determine precise location of the device user. A variety of techniques are employed including simple signal strength weighted average models, nearest neighbor models combined with triangulation techniques and adaptive smoothing based on device velocity. Different algorithms perform better under different scenarios and tend to be used together in hybrid deployments to product the most accurate final readings. Preferred embodiments of the invention can use a number of positioning algorithms. The decision of which algorithm to use is driven by the number of Wi-Fi hotspots observed and the user case application using it. The filtering models differ from traditional positioning systems since traditional systems rely on known reference points that never move. In the model of preferred embodiments, this assumption of fixed locations of Wi-Fi hotspots is not made; the Wi-Fi hotspots are not owned by the positioning system so they may move or be taken offline. The filtering techniques assume that some Wi-Fi hotspots may no longer be located in the same place and could cause a bad location calculation. So the filtering algorithms attempt to isolate the Wi-Fi hotspots that have moved since their position was recorded. The filters are dynamic and change based on the number of Wi-Fi hotspots observed at that moment. The smoothing algorithms include simple position averaging as well as advanced Bayesian logic including particle filters. The velocity algorithms calculate device speed by estimating the Doppler effect from the signal strength observations of each Wi-Fi hotspot.

GloPos' patent pending self learning algorithms claim to calculate an accurate position fix to within 1 to 40 meters even in places where no W-LAN Wi-Fi hotspots are available or no GPS can be used. This process may be substantially different from what has been described in FIG. 12 above and it will be incorporated as that information becomes available.

Figure 13:
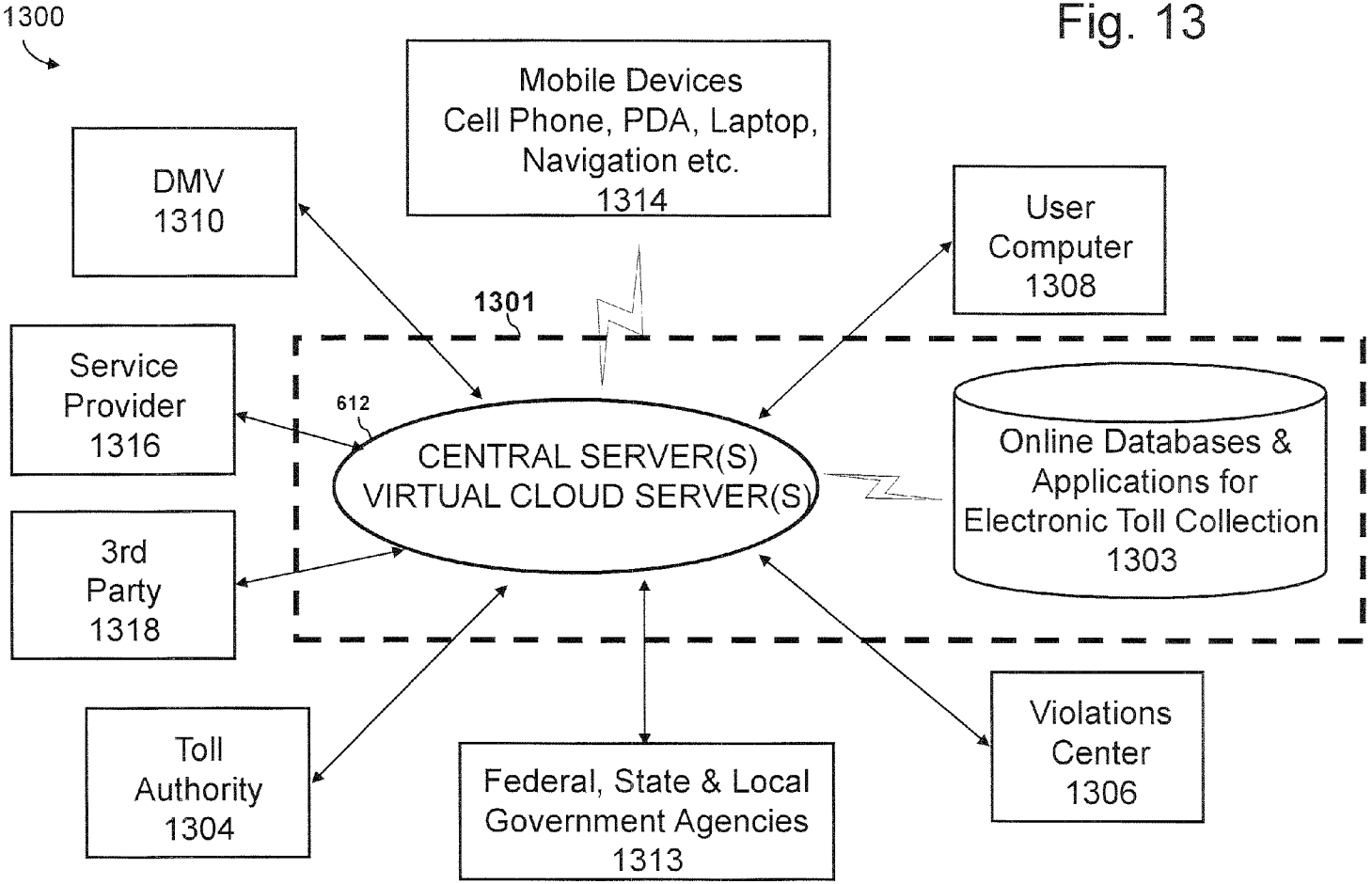
FIG. 13 is an overview of the major system components of the ETC system as an independent system.

With reference now to FIG. 13, an overview of the major system components of the ETC system as an independent system, which includes connections to a variety of remote systems? The independent ETC system (1301) basically consists of the CS (612) plus the online databases and applications (1303). The independent ETC system (1301) communicates with various remote systems. In FIG. 13, the mobile device (1314) communicates with the CS (612), which performs back-office functions such as account creation and maintenance. The CS (612) also communicates with the online electronic toll collection applications and databases (1303) (subscriber database (614)/super block (900), virtual toll location database (615)/super block (1000) and the billing/payments database (616)/super block (1100). The CS (612) also communicates with various remote systems: with toll authorities (1304), to allow account creation, maintenance and resolution of tolls due and tolls paid to occur between and/or among the ETC service (1301), third party systems (1318), service providers (1316) and with a violations center(s) (1306) to process potential violations. The motorist and/or subscriber can also communicate with the CS (612) to maintain their account by connecting over the Internet through a personal computer (1308) or other Internet-enabled device. The CS (612) can also have a connection to a computer (1310) at a DMV or other public authority to allow the mobile device (1314) to verify license information etc. The CS (612) can also have a connection to a computer (1312) at various government agencies to assist with law enforcement and potential homeland security concerns.

Figure 14:
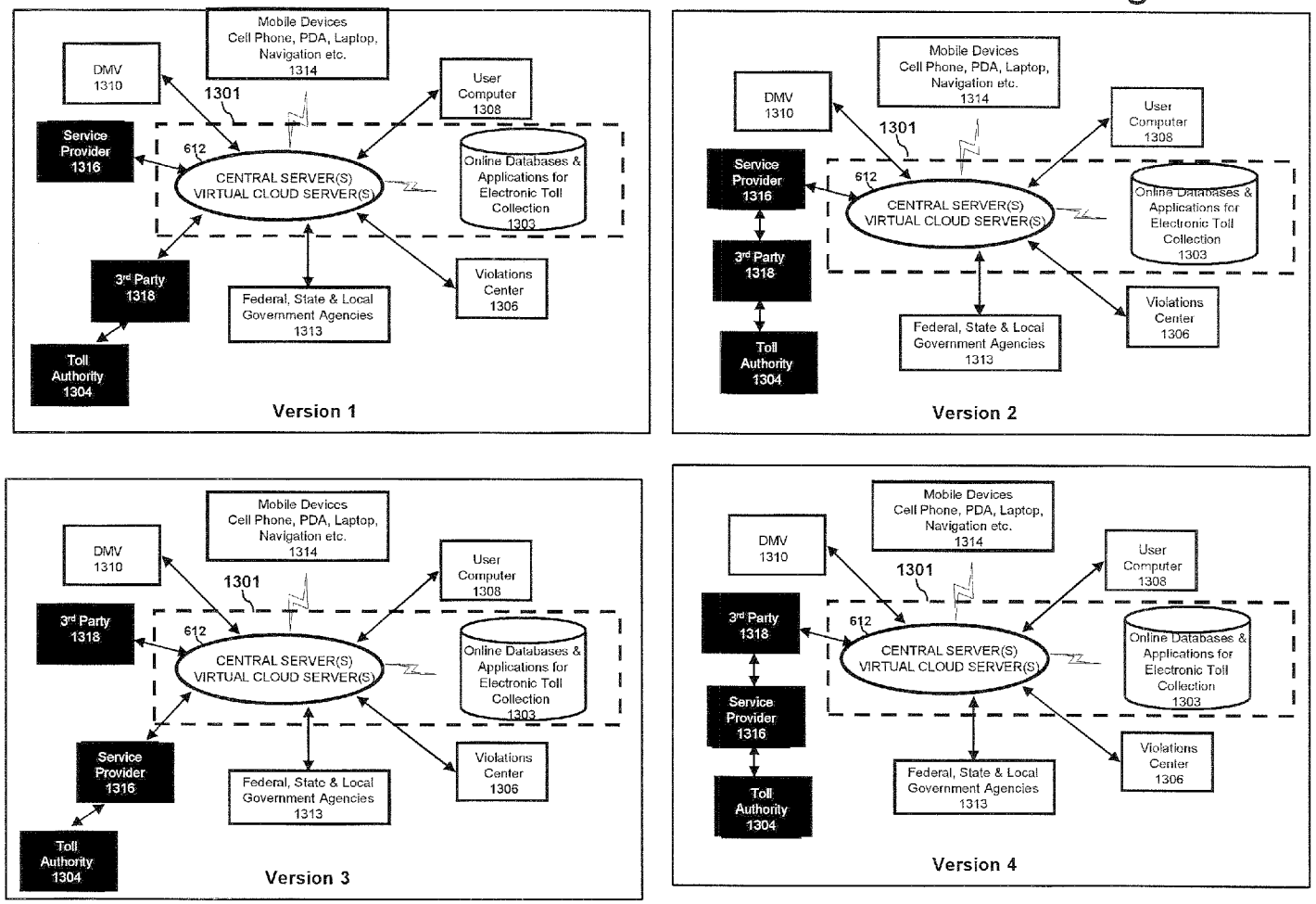
FIG. 14 depicts overviews of the major system components of the ETC system in various dependent system combinations.

FIG. 14 shows four different versions of the independent ETC system shown in FIG. 13. In FIG. 13 the independent ETC system communicates directly with the toll authority. In FIG. 14 each of the four versions of the independent ETC system communicates indirectly with the toll authority (1304). The specific areas of difference in each version have a black background with white lettering. In the upper left hand corner Version 1 in FIG. 14 the independent ETC system (1301) communicates with the toll authority (1304) through a third party (1318). In the upper right hand corner Version 2 in FIG. 14 the independent ETC system communicates first with the service provider (1316) which communicates with a third party (1318) which finally communicates with the toll authority (1304). In the lower left hand corner Version 3 in FIG. 14 the independent ETC system (1301) communicates with the toll authority (1304) through the service provider (1316). In the lower right hand corner Version 4 in FIG. 14 the independent ETC system (1301) communicates first with a third party (1318) which communicates with the service provider (1316) which finally communicates with the toll authority (1304). It should be noted that the present invention may be embodied in forms other than those described in FIG. 14 without departing from the spirit or essential characteristics thereof. The various versions of the independent ETC system contained in FIG. 14 provide sufficient disclosure for one skilled in the art to implement it in numerous combinations and/or permutations, including the preferred embodiment shown in FIG. 13, which should be considered in all aspect as illustrative and not restrictive; all changes or alternatives that fall within the meaning and range or equivalency of FIG. 14 are intended to be embraced within.

Figure 15:
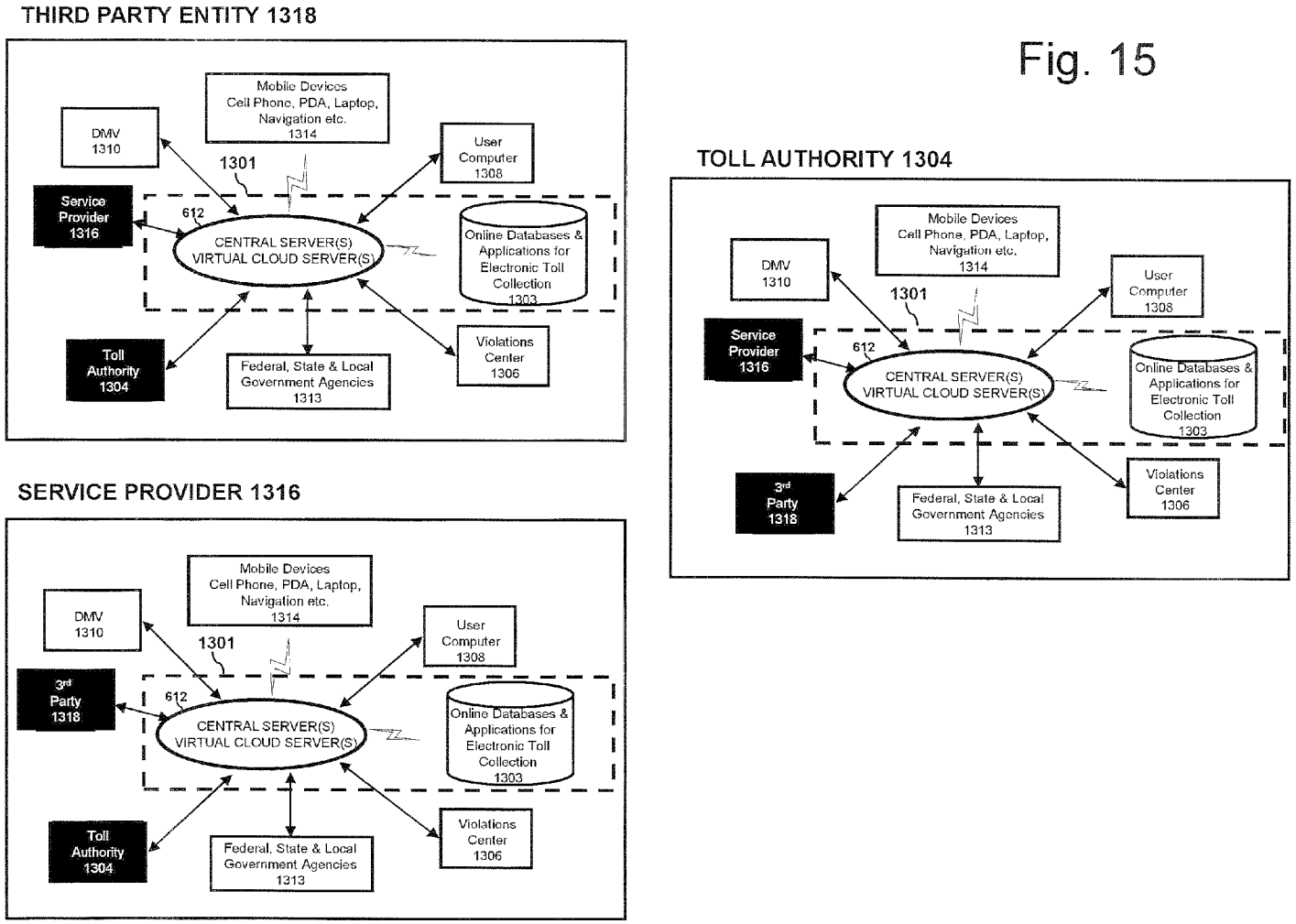
FIG. 15 depicts how the ETC service system could be operated/controlled by a third party(s), a service provider(s) and/or a toll authority(s) and/or any combination thereof.

FIG. 15 depicts how the independent ETC system (1301) could be integrated into a third party entity (1318) system, a service provider (1316) system or a toll authority (1304) system. The upper left hand corner of FIG. 15 shows the independent ETC system within a third party entity (1318) system. The lower left hand corner of FIG. 15 shows the independent ETC system (1301) within a service provider (1316) system. And the right hand side of FIG. 15 shows the independent ETC system (1301) within a toll authority (1304) system. Again it should be noted that the present invention may be embodied in forms other than those described in FIG. 15 without departing from the spirit or essential characteristics thereof. The various versions of the independent ETC system contained in FIG. 15 provide sufficient disclosure for one skilled in the art to implement it in numerous combinations and/or permutations, including the preferred embodiment shown in FIG. 13, which should be considered in all aspect as illustrative and not restrictive; all changes or alternatives that fall within the meaning and range or equivalency of those shown in FIG. 15 are intended to be embraced within.

FIGS. 16, 17, 18 and 19 combine to form an exemplary detail diagram depicting the model of the objects or components of a mobile device location application (1201). This particular example is a Java or J2ME mobile GPS location based application for a Blackberry phone. However, the object model diagram depicted could easily be modified to depict a Google Android SDK location based application or an iPhone location based application or a Symbian based mobile location based application or a Windows mobile location based application or many others.

Figure 16:
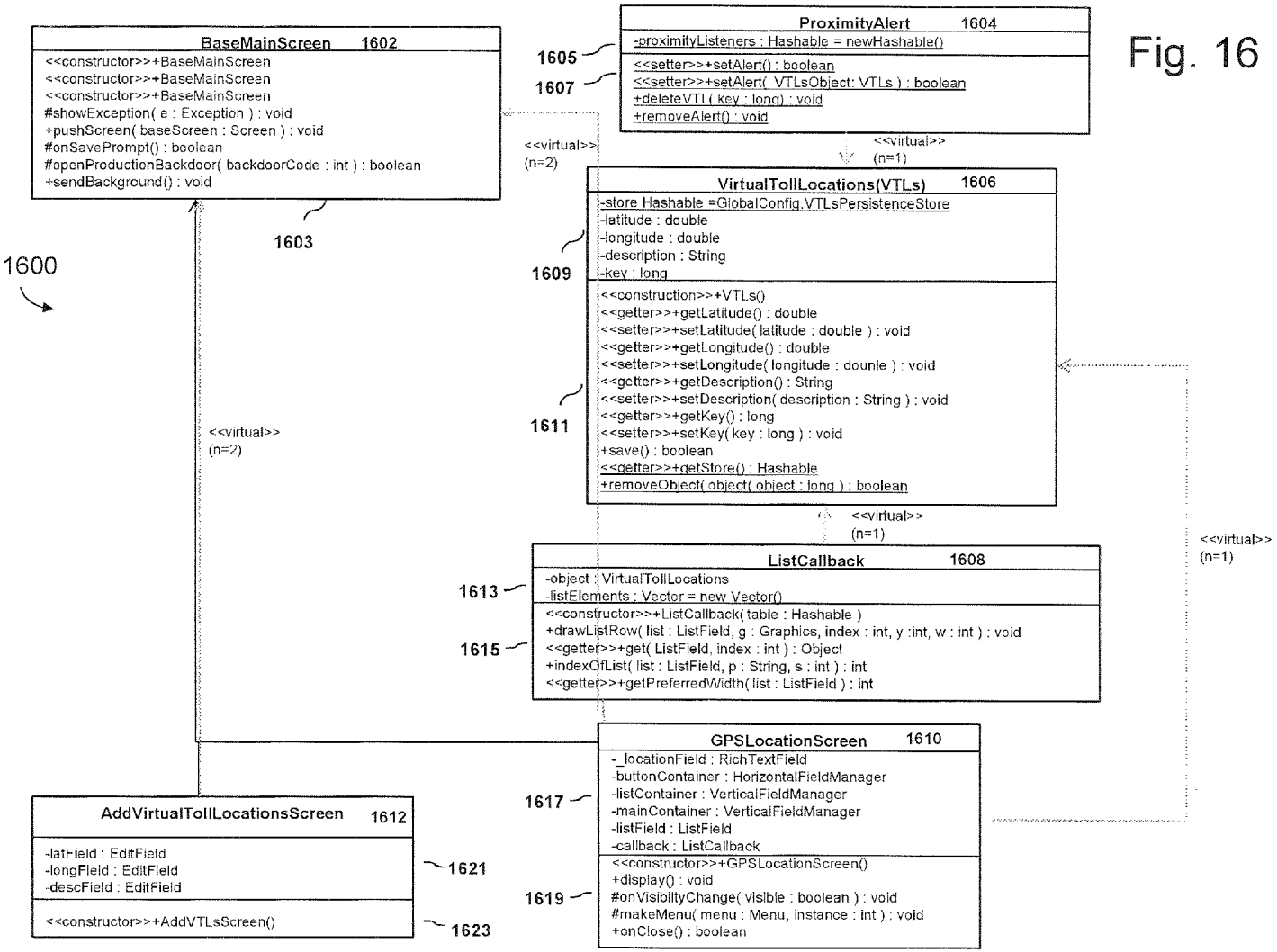

Each object depicted in FIGS. 16, 17, 18 and 19 has a unique name assigned that is spelled out in bold letters at the top of each object. For example the assigned names of the objects in FIG. 16 are BaseMainScreen (1602), ProximityAlert (1604), VirtualTollLocations (VTLs) (1606), ListCallback (1608), GPSLocationScreen (1610) and AddVirtualTollLocationsScreen (1612). These object names are sometimes referenced within other objects. For example, in the ListCallback object (1608), the VirtualTollLocations object (1606) is referenced. Many of the objects are divided by a line into an upper section and a lower section. Both these sections are numbered. For example, the VirtualTollLocations (1606) object consist of an upper section (1609) and a lower section (1611). In general, the upper sections of each object represents data and data attributes. The lower sections describe the functions to be performed on the data by the Java software source code in this particular case. The lines connecting the objects indicate the relationships between and among the objects and what objects are implemented and what sequence and how often.

The business model for the ETC service is as follows:

There would be a per diem and/or a per "virtual" toll location passed charge for the ETC service. However, this could be enhanced by discounted rates if the customer chooses to use the service for multiple days, weeks or months.

First time use could be free or discounted as compensation to the user for the effort of first time registering in the system. First time registration could require a number of one-time activities, including, but not limited to, providing a credit card for use in the current and future, keying in an email address and/or postal address and name, keying in a driver's license number, keying in a license plate number, keying in the make, model and color of the vehicle. These may be entered via the Internet server or using a touch screen keyboard or on the alphanumeric keypad on the mobile device. Upon non-usage for 48 hours the ETC service is closed out with a charge for the actual per diem(s) used and/or per "virtual" toll location(s) passed charge plus the amount of tolls incurred to the registered subscriber's credit card and an email or mail confirmation of the transaction as well as a printed receipt are sent to the service subscriber.

Several business models could be applied to the above ETC service. If the per diem service charge is high enough to provide profitability on those charges per se, the entire discount on tolls could be passed through to the user. However, in an alternative model, a smaller and/or potentially no per diem service charge could be applied, with none or only a part of the toll discount passed through to the user. In this latter case, the ETC service company's profits could come not only from per diem fees and/or per "virtual" toll location fees, but also from the profit margin between the (higher) toll rate charged to the user and the (lower) discounted toll rate paid to the toll authority. Although users would not receive some or the entire discount for ETC, per diem and/or per "virtual" toll location service charges would nevertheless be attractive as a means to avoid stopping, fumbling for change and rolling down a window while waiting in lines of cars to pay in cash at toll locations.

The combination of "virtual" toll locations and mobile devices allows for yet another important business model where the ETC service charges could be a function of miles actually driven on the toll road. This might be viewed as a fairer way to assess toll charges because users would only pay for the miles driven plus the ETC service charge.

Thus, in accordance with the present invention, a motorist and/or subscriber may simply (1) make a call to a wireless service provider to subscribe to a wireless ETC service via a mobile device, (2) activate the wireless ETC service with the mobile device, and (3) drive past a "virtual" toll location with their mobile device turned on. The ETC service would then recognize that the mobile device approaching the "virtual" toll location is associated with a subscriber to the wireless ETC service who has activated such service. In turn, data concerning the transaction would be sent to either the wireless service provider, a third party or the toll authority, and the subscriber's account would be properly billed.

The invention has been described with reference to the preferred embodiments. Obviously, modifications and alterations will occur to others upon reading and understanding the preceding detailed description of the preferred embodiments. It is intended that the invention be construed as including all such modifications and alterations insofar as they come within the scope of the appended claims or the equivalence thereof.

What is claimed is:

1. A method of processing electronic toll collection (ETC) for a motorist and/or subscriber having a wireless mobile device linked to a vehicle and/or billing account, using a wireless service, the method comprising:

receiving a service activation request from the motorist and/or subscriber via the mobile device;

updating a motorist and/or subscriber database record to indicate that wireless ETC service has been activated for the motorist and/or subscriber;

establishing a plurality of waypoints and/or Wi-Fi hotspots to define "virtual" toll locations and/or "virtual" toll barrier(s) and/or "virtual" toll boundary(s) having a given toll(s) that is to be paid by the motorist and/or subscriber;

sensing that the motorist and/or subscriber is within range of and/or is passing a "virtual" toll location(s) and/or a "virtual" toll barrier (s) and/or a "virtual" toll boundary(s);

sending a charge transaction to an ETC system, the charge transaction indicating a toll to be paid by the motorist and/or subscriber as a consequence of the motorist and/or subscriber passing the "virtual" toll location(s) and/or the "virtual" toll barrier(s) and/or the "virtual" toll boundary(s); and generating a billing record for the motorist and/or subscriber indicating that said toll is to be billed to the motorist and/or subscriber.

2. The method defined in claim 1, further comprising:

receiving a communication from the motorist and/or subscriber via the mobile device;

determining a motorist and/or subscriber's subscription status based upon the communication;

updating the motorist and/or subscriber subscription status; and notifying the ETC system of the motorist and/or subscriber's subscription status.

3. The method defined in claim 2, wherein the communication is an activate (subscribe) or deactivate (unsubscribe) request and is initiated via a telephonic connection, via a text messaging connection using a feature activation code, or via an Internet connection.

4. A method of processing electronic toll collection (ETC) for a motorist and/or subscriber having a wireless mobile device linked to a vehicle and/or billing account, using a wireless service, the method comprising:

receiving a service activation communication from the motorist and/or subscriber via the mobile device;

determining the motorist and/or subscriber subscription status based upon the activation communication;

updating the motorist and/or subscriber database record to indicate that wireless ETC service has been activated for the motorist and/or subscriber;

notifying an ETC system of the motorist and/or subscriber's subscription status;

establishing a plurality of waypoints and/or Wi-Fi hotspots to define "virtual" toll locations and/or "virtual" toll barrier(s) and/or "virtual" toll boundary(s) having a given toll(s) that is to be paid by the motorist and/or subscriber;

sensing that the motorist and/or subscriber is within range of and/or is passing a "virtual" toll location(s) and/or a "virtual" toll barrier(s) and/or a "virtual" toll boundary(s);

sending a charge transaction to the ETC system, the charge transaction indicating a toll to be paid by the motorist and/or subscriber as a consequence of the motorist and/or subscriber passing the "virtual" toll location(s) and/or the "virtual" toll barrier(s) and/or the "virtual" toll boundary(s); and generating a billing record for the motorist and/or subscriber indicating that said toll is to be billed to the motorist and/or subscriber.

5. The method defined in claim 4, wherein the service activation request is initiated via a telephone connection, via a text messaging connection using a feature activation code or via an Internet connection.

6. A system for processing ETC for a motorist and/or subscriber having a wireless mobile device linked to a specific vehicle and/or billing account with a wireless service provider(s), $3^{rd}$ party(s) and/or toll authority(s), the system comprising: means for using waypoints and/or Wi-Fi hotspots to define a "virtual" toll location(s) and/or a "virtual" toll barrier(s) and/or a "virtual" toll boundary(s); means for sensing that the motorist and/or subscriber having a mobile device is within range of and/or is passing a "virtual" toll location(s) and/or a "virtual" toll barrier(s) and/or a "virtual" toll boundary(s) having a given toll(s) that is to be paid by the motorist and/or subscriber; means for determining at a CS whether the motorist and/or subscriber has activated a wireless ETC service associated with the mobile device; means for evaluating via the CS whether the subscriber has preselected being billed by the wireless service provider, a third party and/or the toll authority for the account, where it has been determined that the service has been activated by the motorist and/or subscriber; means for sending a charge transaction from the CS to an ETC system, the charge transaction indicating that the toll has not been paid by the motorist and/or subscriber; and means for generating a billing record for the motorist and/or subscriber at the CS and sending a non-charge transaction from the CS to an ETC system, the non-charge transaction indicating that the toll has been billed to the motorist and/or subscriber by the wireless service provider, third party and/or toll authority.

7. The system defined in claim 6, further comprising: means for receiving at the CS a communication from the motorist and/or subscriber via the mobile device; means for determining at the CS a motorist and/or subscriber's subscription status based upon the communication; means for updating via the CS a subscriber database to indicate the subscriber's subscription status; and means for notifying the ETC system of the subscriber's subscription status.

8. The system defined in claim 6, further comprising: means for receiving at the CS a service activation request from the motorist and/or subscriber via the mobile device; and means for updating a subscriber database to indicate that the wireless ETC service has been activated for the subscriber.

9. The system defined in claim 7, further comprising: means for receiving at the CS a service activation request from the subscriber via the communication device; and means for updating the subscriber database to indicate that the wireless ETC service has been activated for the subscriber.

10. A toll fee tracking system comprising: a toll authority adapted to collect data associated with at least one mobile device; a mobile device electronic toll collection (MDETC) entity adapted to communicate with said toll authority and a third party entity; wherein at least some of the collected data is transferred from the toll authority to the MDETC entity responsive to a request for data-transfer permission from the MDETC entity to the toll authority; and wherein said MDETC entity may forward at least some of said transferred data to a third party entity.

11. The system of claim 10, wherein said toll authority comprises: toll gates equipped with toll fee tracking device readers; at least one processor, wherein said at least one processor includes a bi-directional data communications link; and at least one database.

12. The system of claim 10, wherein said MDETC entity comprises: a toll authority interface adapted to communicate with said toll authority; at least one database; and a third party entity interface adapted to communicate with said third party entity.

13. The system of claim 10, wherein said third party entity comprises: at least one mobile device system; at least one invoice unit; and at least one processor.

14. The system of claim 10, wherein said MDETC entity comprises a stand alone unit.

15. The system of claim 14, wherein said MDETC entity comprises a server(s) and/or virtual cloud server(s).

16. The system of claim 10, wherein said communication between said toll authority and said MDETC entity comprises pulling said data from said toll authority.

17. The system of claim 10, wherein said communication between said toll authority and said MDETC entity comprises pushing said data to said MDETC entity.

18. The system of claim 17, wherein said communication between said toll authority and said MDETC entity occurs in real-time.

19. The system of claim 10, wherein said communication between said toll authority and said MDETC entity occurs at predefined regular intervals.

20. The system of claim 10, wherein said communication between said MDETC entity and said third party entity comprises pushing said data to said third party entity.

21. The system of claim 20, wherein said communication between said MDETC entity and said third party entity occurs in real-time.

22. The system of claim 10, wherein said MDETC entity is adapted to be integrated within said third party entity.

23. The system of claim 10, wherein said data includes vehicle-class-identifiers, lane traffic activity, toll fee tracking device identification data, transaction time, transaction date, toll gate identification, vehicle travel direction, and toll fee data.

24. The system of claim 10, wherein said at least one toll fee mobile device comprises a radio frequency integrated device (RFID) transponder.

25. The system of claim 24, wherein said RFID transponder comprises transponder identification data.

26. The system of claim 25, wherein said transponder identification data identifies a MDETC entity account with a toll authority account.

27. A method for toll fee tracking, the method comprising; providing, to a vehicle operator, an automatic toll payment service option; collecting, at a toll authority, data associated with at least one toll fee mobile device; storing said data in at least one database of said toll authority; transferring, from the toll authority to an MDETC entity via a toll authority interface, at least some of the collected and stored data in an MDETC entity database responsive to a request for data-transfer permission from the MDETC entity to the toll authority via the toll authority interface; forwarding, from the MDETC entity to a third party entity via a third party entity interface, at least some of the transferred data; and charging, via at least one mobile device system of the third party entity, the vehicle operator and/or subscriber a fee corresponding to toll usage and applicable service charges based upon the forwarded data.

28. The method of claim 27, wherein said toll authority comprises: toll gates equipped with toll fee tracking device readers; at least one processor, wherein said at least one processor includes a bi-directional data communications link; and at least one database.

29. The method of claim 27, wherein said MDETC entity comprises: the toll authority interface adapted to communicate with said toll authority; at least one database; and the third party entity interface adapted to communicate with said third party entity.

30. The method of claim 27, wherein said third party entity comprises: at least one mobile device system; at least one invoice unit; and at least one processor.

31. The method of claim 27, wherein said MDETC entity comprises a stand alone unit.

32. The method of claim 27, wherein said step of communicating between said toll authority and said MDETC entity comprises pulling said data from said toll authority.

33. The method of claim 27, wherein said step of communicating between said toll authority and said MDETC entity comprises pushing said data to said MDETC entity.

34. The method of claim 33, wherein said step of communicating occurs in real-time.

35. The method of claim 33, wherein said step of communicating occurs at predefined regular intervals.

36. The method of claim 27, wherein said MDETC entity is adapted to be integrated within said third party entity.

37. The method of claim 36, wherein said data includes vehicle-class-identifiers, lane traffic activity, toll fee mobile device identification data, and toll fee data.

38. The method of claim 27, wherein said at least one toll fee mobile devices comprises a radio frequency integrated device (RFID) transponder.

39. The method of claim 27, wherein the option comprises accepting the automatic toll payment service.

40. The method of claim 39, wherein the step of accepting causes the toll fee mobile device to enter an active state.

41. The method of claim 27, wherein the option comprises denying the automatic toll payment service.

42. The method of claim 41, wherein the step of denying causes the toll fee mobile device to enter an inactive state.

43. An MDETC entity server(s) and/or virtual cloud server(s) for communicating data between a toll authority and a third party entity, the server comprising: a first interface for communicating with said toll authority; at least one database; a second interface for communicating with said third party entity; wherein the MDETC entity server(s) transmits a request message via the first interface to a toll authority processor to obtain toll fee tracking data; wherein the toll authority processor receives the request from the first interface and grants permission for the data to be pulled by the MDETC entity server(s) via the first interface; wherein said MDETC entity server(s) pulls the data from said toll authority via the first interface; wherein the MDETC entity server is adapted to analyze the data and calculate an amount to be charged to a vehicle operator associated with a particular toll fee mobile device and forwards the data to said third party entity via the second interface; and wherein upon return of a vehicle by the vehicle operator to the third party entity, the third party entity performs bill handling and is further adapted to charge, via at least one mobile device system of the third party entity, the vehicle operator a fee corresponding to toll usage and applicable service charges based upon the forwarded data and charges associated with a use of the vehicle of the third party entity.

* * * * *